US011451915B2

(12) United States Patent
Fridman et al.

(10) Patent No.: US 11,451,915 B2
(45) Date of Patent: Sep. 20, 2022

(54) APPARATUS, SYSTEM, AND METHOD OF TESTING AN ACOUSTIC DEVICE

(71) Applicant: SILENTIUM LTD., Nes Ziona (IL)

(72) Inventors: Tzvi Fridman, Nes Tziona (IL); Mordehay Elbaz, Tel Aviv-Jaffa (IL); Victor Melichov, Bat-Yam (IL); Iddo Sheinfeld, Beer Yaakov (IL)

(73) Assignee: SILENTIUM LTD., Nes Ziona (IL)

( * ) Notice: Subject to any disclaimer, the term of this patent is extended or adjusted under 35 U.S.C. 154(b) by 0 days.

(21) Appl. No.: 17/519,367

(22) Filed: Nov. 4, 2021

(65) Prior Publication Data

US 2022/0210592 A1 Jun. 30, 2022

Related U.S. Application Data

(60) Provisional application No. 63/131,855, filed on Dec. 30, 2020.

(51) Int. Cl.
*H04R 29/00* (2006.01)

(52) U.S. Cl.
CPC ..... *H04R 29/008* (2013.01); *H04R 29/001* (2013.01); *H04R 29/004* (2013.01)

(58) Field of Classification Search
CPC ... H04R 29/001; H04R 29/008; H04R 29/004
See application file for complete search history.

(56) References Cited

U.S. PATENT DOCUMENTS

2012/0243697 A1 9/2012 Frye
2017/0332179 A1* 11/2017 Bright ..... H04R 23/002
2019/0073192 A1 3/2019 Sheen
2020/0153406 A1* 5/2020 Quan ..... H03G 11/08
2021/0306116 A1* 9/2021 Osmanovic ..... H04L 1/06
2021/0335064 A1* 10/2021 Kim ..... G07C 5/006

FOREIGN PATENT DOCUMENTS

CN 105516873 4/2016
DE 102012000931 7/2013

OTHER PUBLICATIONS

International Search Report and the Written Opinion for International Application No. PCT/IB2021/062431, dated Apr. 25, 2022, 14 pages.

* cited by examiner

*Primary Examiner* — Andrew L Sniezek
(74) *Attorney, Agent, or Firm* — Shichrur & Co.

(57) ABSTRACT

Some demonstrative embodiments include apparatuses, systems and/or methods of testing an acoustic device, an acoustic component, and/or a device or system including one or more acoustic devices. For example, an acoustic device tester may be configured to process input acoustic information of a tested acoustic device to determine a tested acoustic value distribution for the tested acoustic device in a plurality of frequency sub-bands; determine whether or not the tested acoustic device meets a predefined testing criterion based on the tested acoustic value distribution and a reference profile defining a plurality of reference values corresponding to the plurality of frequency sub-bands, respectively; and generate an output to indicate whether or not the tested acoustic device meets the predefined testing criterion.

27 Claims, 16 Drawing Sheets

200

500

APPARATUS, SYSTEM, AND METHOD OF TESTING AN ACOUSTIC DEVICE

CROSS-REFERENCE

This application claims the benefit of and priority from U.S. Provisional Patent Application No. 63/131,855, entitled "APPARATUS, SYSTEM, AND METHOD OF TESTING AN ACOUSTIC DEVICE", filed Dec. 30, 2020, the entire disclosure of which is incorporated herein by reference.

TECHNICAL FIELD

Embodiments described herein generally relate to testing an acoustic device.

BACKGROUND

Many system and/or devices may include acoustic devices, for example, a microphone, a speaker, or the like.

There is a need to test an acoustic device, for example, to verify that the acoustic device meets one or more functionalities and/or specs, and/or to verify that the acoustic device is not damaged during a manufacturing process.

BRIEF DESCRIPTION OF THE DRAWINGS

For simplicity and clarity of illustration, elements shown in the figures have not necessarily been drawn to scale. For example, the dimensions of some of the elements may be exaggerated relative to other elements for clarity of presentation. Furthermore, reference numerals may be repeated among the figures to indicate corresponding or analogous elements. The figures are listed below.

DETAILED DESCRIPTION

Figure 1:
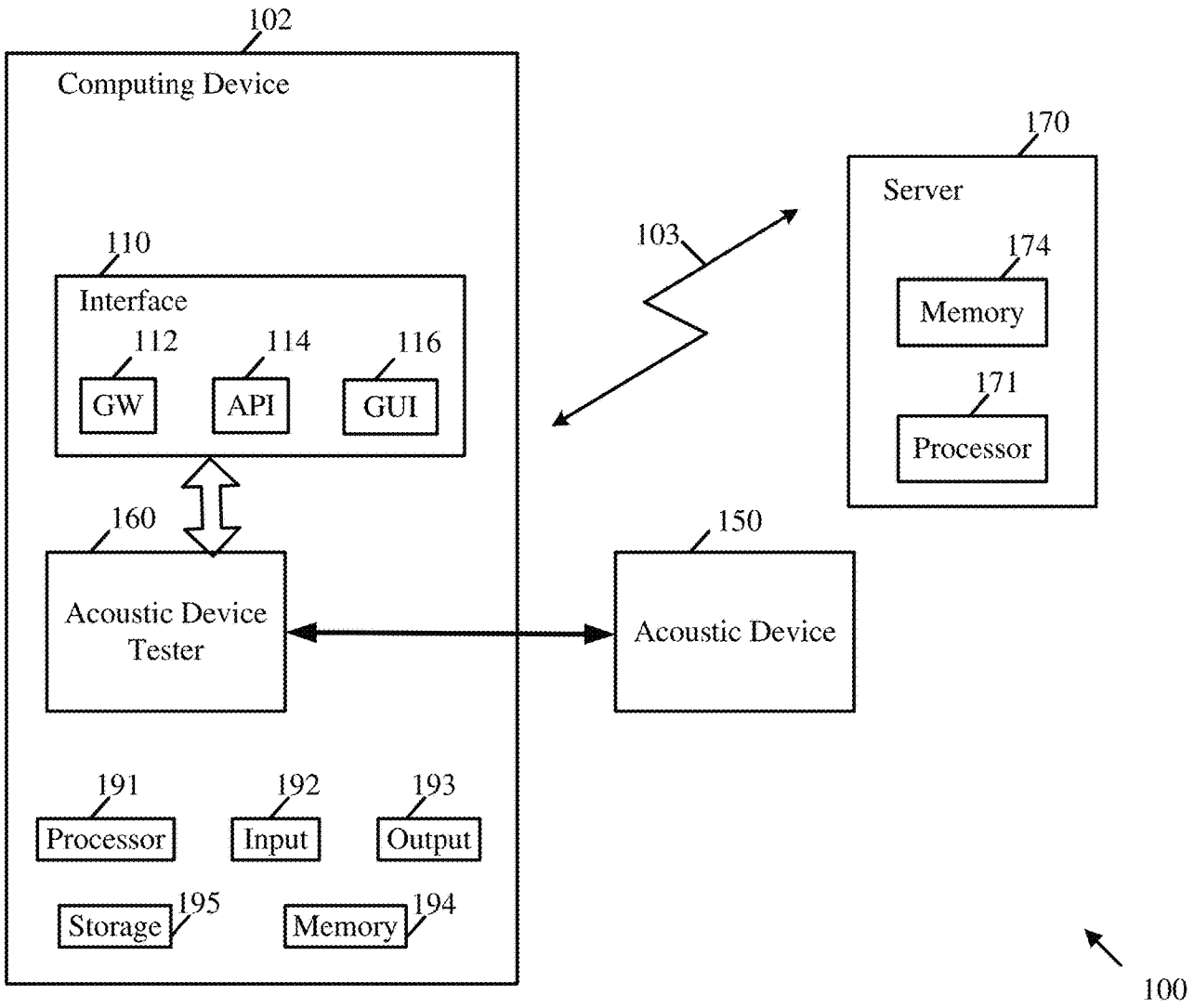
FIG. 1 is a schematic block diagram illustration of a system, in accordance with some demonstrative embodiments.

In the following detailed description, numerous specific details are set forth in order to provide a thorough understanding of some embodiments. However, it will be understood by persons of ordinary skill in the art that some embodiments may be practiced without these specific details. In other instances, well-known methods, procedures, components, units and/or circuits have not been described in detail so as not to obscure the discussion.

Some portions of the following detailed description are presented in terms of algorithms and symbolic representations of operations on data bits or binary digital signals within a computer memory. These algorithmic descriptions and representations may be the techniques used by those skilled in the data processing arts to convey the substance of their work to others skilled in the art.

An algorithm is here, and generally, considered to be a self-consistent sequence of acts or operations leading to a desired result. These include physical manipulations of physical quantities. Usually, though not necessarily, these quantities capture the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Discussions herein utilizing terms such as, for example, "processing", "computing", "calculating", "determining", "establishing", "analyzing", "checking", or the like, may refer to operation(s) and/or process(es) of a computer, a computing platform, a computing system, or other electronic computing device, that manipulate and/or transform data represented as physical (e.g., electronic) quantities within the computer's registers and/or memories into other data similarly represented as physical quantities within the computer's registers and/or memories or other information storage medium that may store instructions to perform operations and/or processes.

The terms "plurality" and "a plurality", as used herein, include, for example, "multiple" or "two or more". For example, "a plurality of items" includes two or more items.

References to "one embodiment", "an embodiment", "demonstrative embodiment", "various embodiments" etc., indicate that the embodiment(s) so described may include a particular feature, structure, or characteristic, but not every embodiment necessarily includes the particular feature, structure, or characteristic. Further, repeated use of the phrase "in one embodiment" does not necessarily refer to the same embodiment, although it may.

As used herein, unless otherwise specified the use of the ordinal adjectives "first", "second", "third" etc., to describe a common object, merely indicate that different instances of like objects are being referred to, and are not intended to imply that the objects so described must be in a given sequence, either temporally, spatially, in ranking, or in any other manner.

Some embodiments, for example, may capture the form of an entirely hardware embodiment, an entirely software embodiment, or an embodiment including both hardware and software elements. Some embodiments may be implemented in software, which includes but is not limited to firmware, resident software, microcode, or the like.

Furthermore, some embodiments may capture the form of a computer program product accessible from a computer-usable or computer-readable medium providing program code for use by or in connection with a computer or any instruction execution system. For example, a computer-usable or computer-readable medium may be or may include any apparatus that can contain, store, communicate, propagate, or transport the program for use by or in connection with the instruction execution system, apparatus, or device.

In some demonstrative embodiments, the medium may be an electronic, magnetic, optical, electromagnetic, infrared, or semiconductor system (or apparatus or device) or a propagation medium. Some demonstrative examples of a computer-readable medium may include a semiconductor or solid state memory, magnetic tape, a removable computer diskette, a random access memory (RAM), a read-only memory (ROM), a FLASH memory, a rigid magnetic disk, and an optical disk. Some demonstrative examples of optical disks include compact disk-read only memory (CD-ROM), compact disk-read/write (CD-R/W), and DVD.

In some demonstrative embodiments, a data processing system suitable for storing and/or executing program code may include at least one processor coupled directly or indirectly to memory elements, for example, through a system bus. The memory elements may include, for example, local memory employed during actual execution of the program code, bulk storage, and cache memories which may provide temporary storage of at least some program code in order to reduce the number of times code must be retrieved from bulk storage during execution.

In some demonstrative embodiments, input/output or I/O devices (including but not limited to keyboards, displays, pointing devices, etc.) may be coupled to the system either directly or through intervening I/O controllers. In some demonstrative embodiments, network adapters may be coupled to the system to enable the data processing system to become coupled to other data processing systems or remote printers or storage devices, for example, through intervening private or public networks. In some demonstrative embodiments, modems, cable modems and Ethernet cards are demonstrative examples of types of network adapters. Other suitable components may be used.

Some embodiments may include one or more wired or wireless links, may utilize one or more components of wireless communication, may utilize one or more methods or protocols of wireless communication, or the like. Some embodiments may utilize wired communication and/or wireless communication.

Some embodiments may be used in conjunction with various devices and systems, for example, an acoustic device, a device or system implementing one or more acoustic devices, an Active Noise Control (ANC) device or system, an Active Acoustic Control (AAC) device or system, a user device, a consumer device, a mobile phone, a Smartphone, a mobile computer, a laptop computer, a notebook computer, a tablet computer, a handheld computer, a handheld device, a Personal Digital Assistant (PDA) device, a handheld PDA device, a mobile or portable device, a non-mobile or non-portable device, a cellular telephone, a wireless telephone, a device having one or more internal antennas and/or external antennas, a wireless handheld device, or the like.

Reference is now made to FIG. 1, which schematically illustrates a block diagram of a system 100, in accordance with some demonstrative embodiments.

As shown in FIG. 1, in some demonstrative embodiments system 100 may include a computing device 102.

In some demonstrative embodiments, device 102 may be implemented using suitable hardware components and/or software components, for example, processors, controllers, memory units, storage units, input units, output units, communication units, operating systems, applications, or the like.

In some demonstrative embodiments, device 102 may include, for example, a computing device, a desktop computer, a mobile computer, a mobile device, a dedicated computing device, a consumer device, a user device, a mobile phone, a Smartphone, a Cellular phone, a notebook, a mobile computer, a laptop computer, a notebook computer, a tablet computer, a handheld computer, a handheld device, or the like.

In some demonstrative embodiments, device 102 may include, for example, one or more of a processor 191, an input unit 192, an output unit 193, a memory unit 194, and/or a storage unit 195. Device 102 may optionally include other suitable hardware components and/or software components. In some demonstrative embodiments, some or all of the components of one or more of device 102 may be enclosed in a common housing or packaging, and may be interconnected or operably associated using one or more wired or wireless links. In other embodiments, components of one or more of device 102 may be distributed among multiple or separate devices.

In some demonstrative embodiments, processor 191 may include, for example, a Central Processing Unit (CPU), a Digital Signal Processor (DSP), one or more processor cores, a single-core processor, a dual-core processor, a multiple-core processor, a microprocessor, a host processor, a controller, a plurality of processors or controllers, a chip, a microchip, one or more circuits, circuitry, a logic unit, an Integrated Circuit (IC), an Application-Specific IC (ASIC), or any other suitable multi-purpose or specific processor or controller. Processor 191 may execute instructions, for example, of an Operating System (OS) of device 102 and/or of one or more suitable applications.

In some demonstrative embodiments, input unit 192 may include, for example, a keyboard, a keypad, a mouse, a touch-screen, a touch-pad, a track-ball, a stylus, a microphone, or other suitable pointing device or input device. Output unit 193 may include, for example, a monitor, a screen, a touch-screen, a flat panel display, a Light Emitting Diode (LED) display unit, a Liquid Crystal Display (LCD) display unit, a plasma display unit, one or more audio speakers or earphones, or other suitable output devices.

In some demonstrative embodiments, memory unit 194 includes, for example, a Random Access Memory (RAM), a Read Only Memory (ROM), a Dynamic RAM (DRAM), a Synchronous DRAM (SD-RAM), a flash memory, a volatile memory, a non-volatile memory, a cache memory, a buffer, a short term memory unit, a long term memory unit, or other suitable memory units. Storage unit 195 may include, for example, a hard disk drive, a Solid State Drive (SSD), or other suitable removable or non-removable storage units. Memory unit 194 and/or storage unit 195, for example, may store data processed by device 102.

In some demonstrative embodiments, device 102 may be configured to communicate with one or more other devices via wireless and/or wired network 103.

In some demonstrative embodiments, network 103 may include a wired network, a local area network (LAN), a wireless LAN (WLAN) network, a radio network, a cellular network, a Wi-Fi network, an IR network, a Bluetooth (BT) network, and the like.

In some demonstrative embodiments, device 102 may allow one or more users to interact with one or more processes, applications and/or modules of device 102, e.g., as described herein.

In some demonstrative embodiments, device 102 may be configured to test and/or diagnose one or more acoustic devices 150, e.g., as described below.

In one example, the acoustic device 150 may include, for example, an acoustic actuator device, e.g., a speaker, a loudspeaker, a shaker, a piezo electric element, and/or any other acoustic transducer configured to generate acoustic energy.

In another example, the acoustic device 150 may include, for example, an acoustic sensor device, e.g., a microphone, an accelerometer and/or any other acoustic sensor configured to sense acoustic energy.

In some demonstrative embodiments, acoustic device 150 may be implemented as part of computing device 102. In other embodiments, acoustic device 150 and computing device 102 may be implemented as two separate elements or devices of system 100.

In some demonstrative embodiments, device 102 may be configured to test a product, which may be equipped with one or more acoustic devices 150, e.g., a smartphone, a Television (TV), a media device, a vehicle equipped with one or more acoustic devices, and/or the like.

For example, the acoustic devices 150 may be part of an audio system and/or an infotainment system, an apparatus or system with Active Noise control (ANC), an apparatus or system with Active Acoustic Control (AAC), an apparatus or system with Active Vibration Control (AVC), a voice activated apparatus or system, for example, a navigator, headphones, vehicles, TVs, and/or the like.

In some demonstrative embodiments, device 102 may be configured to support an automated test to check a functionality specification (spec) and/or performance for acoustic devices 150, e.g., as described below.

In some demonstrative embodiments, device 102 may be configured to provide diagnostics for the acoustic devices 150, and/or to verify whether the acoustic devices 150 have been damaged, e.g., during manufacturing and/or during assembly.

In some demonstrative embodiments, device 102 may be configured to test and/or diagnose the one or more acoustic devices 150, for example, when the acoustic devices 150 are part of a system. For example, device 102 may be configured to test a system or product, in which the acoustic devices 150 may be assembled and/or integrated, e.g., as described below.

In some demonstrative embodiments, device 102 may be configured to test and/or diagnose the one or more acoustic devices 150, for example, at an End Of Line (EOL) of a manufacturing process, for example, at an EOL of a manufacturing process to manufacture the acoustic devices 150, e.g., as described below.

In some demonstrative embodiments, device 102 may be configured to test and/or diagnose the acoustic devices 150, for example, at an EOL of a manufacturing process of a product including one or more acoustic devices 150, for example, after assembly and/or integration of the acoustic devices 150, e.g., as described below.

In some demonstrative embodiments, device 102 may be configured to test and/or diagnose the acoustic devices 150, for example, during runtime of a product by an end user, e.g., as described below.

In some demonstrative embodiments, device 102 may be configured to test and/or diagnose the acoustic devices 150, for example, in one or more manufacturing sites, at which the acoustic devices 150 may be manufactured, e.g., as described below.

In one example, device 102 may be configured to test the functionality spec and/or performance of the acoustic devices 150 and/or to provide diagnostic information for acoustic devices 150 manufactured at the production sites. For example, the diagnostic information may enable to screen, sort, and/or verify specifications of the acoustic devices 150, and/or to identify and/or screen faulty acoustic devices 150, e.g., as described below.

In some demonstrative embodiments, for example, an acoustic device 150 may be faulty, for example, if the acoustic device 150 fails to meet one or more predefined criteria, for example, according to a predefined specification, e.g., as described below.

In some demonstrative embodiments, device 102 may include an acoustic device tester 160 configured to test and/or diagnose the acoustic devices 150, for example, according to one or testing schemes. e.g., as described below.

In some demonstrative embodiments, acoustic device tester 160 may include at least one service, module, controller, and/or application configured to test and/or diagnose the acoustic devices 150, for example, according to the one or testing schemes, e.g., as described below.

In some demonstrative embodiments, acoustic device tester 160 may include, or may be implemented as, software, a software module, an application, a program, a subroutine, instructions, an instruction set, computing code, words, values, symbols, and the like.

In some demonstrative embodiments, acoustic device tester 160 may be configured to test and/or diagnose an acoustic device 150, for example, according to the one or more testing schemes, as described below.

In some demonstrative embodiments, acoustic device tester 160 may be configured to test and/or diagnose the acoustic device 150, for example, based on acoustic information corresponding to the acoustic device 150, which may be received, for example, via input 192, e.g., as described below.

In some demonstrative embodiments, acoustic device tester 160 may be configured to test and/or diagnose the acoustic device 150, for example, based on the acoustic information, and to output, e.g., via output 193, diagnostic information corresponding to the acoustic device 150, e.g., as described below.

In some demonstrative embodiments, acoustic device tester 160 may include a local application to be executed by device 102. For example, memory unit 194 and/or storage unit 195 may store instructions resulting in acoustic device tester 160, and/or processor 191 may be configured to execute the instructions resulting in acoustic device tester 160 and/or to perform one or more calculations and/or processes of acoustic device tester 160, e.g., as described below.

In other embodiments, acoustic device tester 160 may include a remote application to be executed by any suitable computing system, e.g., a server 170.

In some demonstrative embodiments, server 170 may include at least one of a remote server, a web-based server, a cloud server, and/or any other server.

In some demonstrative embodiments, the server 170 may include a suitable memory and/or storage unit 174 having stored thereon instructions resulting in acoustic device tester 160, and a suitable processor 171 to execute the instructions, e.g., as descried below.

In some demonstrative embodiments, acoustic device tester 160 may include a combination of a remote application and a local application.

In one example, acoustic device tester 160 may be downloaded and/or received by the user of device 102 from another computing system, e.g., server 170, such that acoustic device tester 160 may be executed locally by users of device 102. For example, the instructions may be received and stored, e.g., temporarily, in a memory or any suitable short-term memory or buffer of device 102, e.g., prior to being executed by processor 191 of device 102.

In another example, acoustic device tester 160 may include a front-end to be executed locally by device 102, and a backend to be executed by server 170. For example, the front end may include and/or may be implemented as a local application, a web application, a web site, a web client, e.g., a Hypertext Markup Language (HTML) web application or the like.

For example, one or more first operations of testing the acoustic device may be performed locally, for example, by device 102, and/or one or more second operations of testing the acoustic device may be performed remotely, for example, by server 170, e.g., as described below.

In other embodiments, acoustic device tester 160 may include, or may be implemented by, any other suitable computing arrangement and/or scheme.

In some demonstrative embodiments, system 100 may include an interface 110, e.g., a user interface, to interface between a user of device 102 and one or more elements of system 100, e.g., acoustic device tester 160.

In some demonstrative embodiments, interface 110 may be implemented using any suitable hardware components and/or software components, for example, processors, controllers, memory units, storage units, input units, output units, communication units, operating systems, and/or applications.

In some embodiments, interface 110 may be implemented as part of any suitable module, system, device, or component of system 100.

In other embodiments, interface 110 may be implemented as a separate element of system 100.

In some demonstrative embodiments, interface 110 may be implemented as part of device 102. For example, interface 110 may be associated with and/or included as part of device 102.

In one example, interface 110 may be implemented, for example, as middleware, and/or as part of any suitable application of device 102. For example, interface 110 may be implemented as part of acoustic device tester 160 and/or as part of an OS of device 102.

In some demonstrative embodiments, interface 110 may be implemented as part of server 170. For example, interface 110 may be associated with and/or included as part of server 170.

In one example, interface 110 may include, or may be part of a Web-based application, a web-site, a web-page, a plug-in, an ActiveX control, a rich content component, e.g., a Flash or Shockwave component, or the like.

In some demonstrative embodiments, interface 110 may be associated with and/or may include, for example, a gateway (GW) 112 and/or an Application Programming Interface (API) 114, for example, to communicate information and/or communications between elements of system 100 and/or to one or more other, e.g., internal or external, parties, users, applications and/or systems.

In some embodiments, interface 110 may include any suitable Graphic-User-Interface (GUI) 116 and/or any other suitable interface.

In one example, acoustic device tester 160 may be configured to test and/or diagnose the acoustic device 150 locally, for example, if acoustic device tester 160 is locally implemented by device 102. According to this example, acoustic device tester 160 may be configured to test and/or diagnose the acoustic device 150, e.g., based on the acoustic information corresponding to acoustic device 150, and to output, e.g., via output 193, diagnostic information corresponding to acoustic device 150, e.g., as described below.

In another example, acoustic device tester 160 may be configured to test and/or diagnose the acoustic device remotely, for example, if acoustic device tester 160 is implemented by server 170, or if a back-end of acoustic device tester 160 is implemented by server 170, e.g., while a front-end of acoustic device tester 160 is implemented by device 102. According to this example, acoustic device tester 160 may be configured to send the acoustic information of acoustic device 150 to server 170 and/or the back-end of acoustic device tester 160; and server 170 and/or the back-end of acoustic device tester 160 may be configured to test and/or diagnose the acoustic device 150, e.g., based on the acoustic information from the front-end of acoustic device tester 160, and to send to device 102 the diagnostic information corresponding to acoustic device 150, e.g., as described below.

In some demonstrative embodiments, acoustic device tester 160 may be configured to test and/or diagnose acoustic device 150, for example, as a standalone product, for example, at an EOL of a manufacturing process, e.g., as described below.

In some demonstrative embodiments, acoustic device tester 160 may be configured to test and/or diagnose acoustic device 150, for example, as part of a system, a product and/or a device in which acoustic device 150 may be assembled and/or integrated, e.g., as described below.

In some demonstrative embodiments, acoustic device tester 160 may be configured to test and/or diagnose acoustic device 150, for example, when acoustic device 150 is already assembled or integrated as part of a mobile device, for example, a smartphone, e.g., as described below.

In some demonstrative embodiments, acoustic device tester 160 may be configured to test and/or diagnose acoustic device 150, for example, when acoustic device 150 is already assembled or integrated as part of an Active Noise Control (ANC) system and/or an AAC system, e.g., as described below.

In some demonstrative embodiments, acoustic device tester 160 may be configured to test and/or diagnose one or more acoustic devices 150, for example, which are assembled or integrated, for example, as part of a vehicle, for example, as part of an ANC system or AAC system of the vehicle. For example, the AAC system may be configured to control sound in a vehicle cabin, e.g., as described below.

Some demonstrative embodiments are described below with respect to testing one or more acoustic devices 150 implemented as part of an AAC system. Other embodiments may be implemented to test one or more acoustic devices 150 implemented as part of any other device, product and/or system. For example, some embodiments may be implemented to test one or more acoustic devices 150 implemented as part of any product that is equipped with acoustic sensors, e.g., microphones, accelerometers, and/or the like; and/or acoustic actuators, e.g., speakers, shakers, vibration actuators, and/or the like. For example, some embodiments may be implemented to test one or more acoustic devices 150 implemented as part of one or more audio devices, one or more infotainments systems, cameras, headphones, earbuds, or the like.

In some demonstrative embodiments, acoustic device tester 160 may be configured to test and/or diagnose the acoustic devices 150, for example, at an EOL of a manufacturing process, e.g., an EOL of a manufacturing process of the acoustic devices 150, and/or an EOL of a manufacturing process of a product, system, and/or device including the acoustic devices 150, e.g., as described below.

In some demonstrative embodiments, acoustic device tester 160 may be configured to test and/or diagnose a plurality of acoustic devices 150 in a product, for example, to verify that some or all system acoustic elements, e.g., physical sensors and/or components, achieve one or more predefined testing criteria, for example, a defined sensitivity, and/or a frequency response tolerance. For example, the one or more predefined testing criteria may be configured to ensure product operation to deliver optimal system performance and/or functionality, e.g., as described below.

In some demonstrative embodiments, acoustic device tester 160 may be configured to test and/or diagnose the acoustic devices 150, for example, to identify faulty sensors and/or components, for example, after production and/or after assembly, e.g., as described below.

In some demonstrative embodiments, acoustic device tester 160 may be configured to test and/or diagnose the acoustic devices 150, for example, as part of a manufacturing process of the acoustic devices 150, for example, at a production site of a manufacturer of acoustic sensors and/or acoustic actuators, e.g., as described below.

In some demonstrative embodiments, acoustic device tester 160 may be configured to test and/or diagnose the acoustic devices 150, for example, on a system level, e.g., at a product EOL manufacturing process, for example, after a product is equipped with acoustic sensors and/or actuators, e.g., as described below.

In some demonstrative embodiments, acoustic device tester 160 may be configured to test and/or diagnose one or more acoustic devices 150, for example, during runtime of a product including the acoustic devices 150, e.g., when the product is operating by an end customer, e.g., as described below.

In some demonstrative embodiments, acoustic device tester 160 may be configured to analyze Runtime (RT) signal characteristics and/or transfer functions of the acoustic devices 150, which may be captured at RT, e.g., using signal processing technics, for example, at an assembly line, e.g., as described below.

In some demonstrative embodiments, acoustic device tester 160 may be configured to analyze RT signal characteristics and/or transfer functions of the acoustic devices 150, which may be captured at RT, e.g., using signal processing technics, for example, during real-time operation of a product implementing the acoustic devices 150, e.g., as described below.

In some demonstrative embodiments, acoustic devices 150 may be subject to pre-defined conditions for conducting an automated test simulating operation conditions of the acoustic devices 150, e.g., as described below.

In some demonstrative embodiments, acoustic device tester 160 may be configured to test and/or diagnose an acoustic device 150, for example, based on acoustic information of the acoustic device 150, e.g., as described below.

In some demonstrative embodiments, acoustic device tester 160 may be configured to process input acoustic information of a tested acoustic device 150 to determine a tested Acoustic Value Distribution (AVD) for the tested acoustic device 150 in a plurality of frequency sub-bands, e.g., as described below.

In some demonstrative embodiments, the tested acoustic value distribution for the tested acoustic device 150 may include a plurality of tested values in the plurality of frequency sub-bands, respectively, e.g., as described below.

In some demonstrative embodiments, the plurality of frequency sub-bands may include a plurality of ⅓-octave bands, e.g., as described below.

In some demonstrative embodiments, the plurality of frequency sub-bands may include at least 5 frequency sub-bands, e.g., as described below.

In some demonstrative embodiments, the plurality of frequency sub-bands may include at least 18 frequency sub-bands, e.g., as described below.

In other embodiments, any other count and/or configuration of the plurality of frequency sub-bands may be implemented.

In some demonstrative embodiments, acoustic device tester 160 may be configured to determine whether or not the tested acoustic device 150 meets a predefined testing criterion, for example, based on the tested acoustic value distribution and a reference profile defining a plurality of reference values (also referred to as a "Golden AVD") corresponding to the plurality of frequency sub-bands, respectively, e.g., as described below.

In some demonstrative embodiments, acoustic device tester 160 may be configured to generate an output to indicate whether or not the tested acoustic device meets the predefined testing criterion. For example, acoustic device tester 160 may be configured to provide output to interface 110.

In some demonstrative embodiments, the tested AVD of the tested acoustic device 150 may include and/or represent a tested acoustic transfer function of the tested acoustic device 150, e.g., as described below.

In one example, the tested acoustic transfer function of the tested acoustic device 150 may include, may be based on, and/or may represent, a Microphone Transfer Function (MTF) of the tested acoustic device 150, e.g., as described below.

In one example, the tested acoustic transfer function of the tested acoustic device 150 may include, may be based on, and/or may represent, a Speaker Transfer Function (STF) of the tested acoustic device 150, e.g., as described below.

In other embodiments, the tested acoustic transfer function of the tested acoustic device 150 may include, may be based on, and/or may represent, a combination of transfer function and/or any other transfer function.

In some demonstrative embodiments, the tested AVD of the tested acoustic device 150 may include and/or represent a tested acoustic spectrum of the tested acoustic device 150.

In other embodiments, the tested AVD of the tested acoustic device 150 may include and/or represent any other tested acoustic signal, parameter and/or attribute of the tested acoustic device 150.

In some demonstrative embodiments, the tested AVD of the tested acoustic device 150 may include a tested acoustic energy distribution of the tested acoustic device 150. For example, the tested acoustic energy distribution of the tested acoustic device 150 may include a plurality of tested energy values in the plurality of frequency sub-bands, e.g., as described below.

In other embodiments, the tested AVD of the tested acoustic device 150 may include a tested acoustic amplitude distribution of the tested acoustic device 150. For example, the tested acoustic amplitude distribution of the tested acoustic device 150 may include a plurality of tested amplitude values in the plurality of frequency sub-bands, e.g., as described below.

In other aspects, the tested AVD of the tested acoustic device 150 may include any other acoustic value distribution corresponding to any other acoustic values and/or parameters.

In some demonstrative embodiments, acoustic device tester 160 may be configured to process input acoustic information of the tested acoustic device 150 to determine a tested acoustic transfer function of the tested acoustic device 150 in a plurality of frequency sub-bands, e.g., as described below.

In some demonstrative embodiments, the tested acoustic transfer function of the tested acoustic device 150 may include a plurality of tested energy values in the plurality of frequency sub-bands, respectively, e.g., as described below.

In some demonstrative embodiments, acoustic device tester 160 may be configured to determine whether or not the tested acoustic device 150 meets a predefined testing criterion, for example, based on the tested acoustic transfer function and a reference profile defining a plurality of reference energy values corresponding to the plurality of frequency sub-bands, respectively, e.g., as described below.

In some demonstrative embodiments, the tested acoustic transfer function of the tested acoustic device 150 may include a plurality of tested energy values in the plurality of frequency sub-bands, respectively, e.g., as described below.

In some demonstrative embodiments, acoustic device tester 160 may be configured to determine whether or not the tested acoustic device 150 meets a predefined testing criterion, for example, based on the tested acoustic transfer function and a reference profile defining a plurality of reference energy values corresponding to the plurality of frequency sub-bands, respectively, e.g., as described below.

In some demonstrative embodiments, the tested acoustic transfer function of the tested acoustic device 150 may include a plurality of tested amplitude values in the plurality of frequency sub-bands, respectively.

In some demonstrative embodiments, acoustic device tester 160 may be configured to determine whether or not the tested acoustic device 150 meets a predefined testing criterion, for example, based on the tested acoustic transfer function and a reference profile defining a plurality of reference amplitude values corresponding to the plurality of frequency sub-bands, respectively, e.g., as described below.

In some demonstrative embodiments, acoustic device tester 160 may be configured to determine whether the tested acoustic device 150 meets the predefined testing criterion, for example, based on a difference value corresponding to a frequency sub-band, e.g., as described below.

In some demonstrative aspects, the difference value may include a difference between a tested value corresponding to the frequency sub-band and a reference value corresponding to the frequency sub-band, e.g., as described below.

In some demonstrative embodiments, acoustic device tester 160 may be configured to determine that the tested acoustic device 150 fails to meet the predefined testing criterion, for example, based on a determination that the difference value corresponding to the frequency sub-band is greater than the threshold corresponding to the frequency sub-band, e.g., as described below.

In some demonstrative embodiments, acoustic device tester 160 may be configured to determine whether the tested acoustic device 150 meets the predefined testing criterion, for example, based on an energy difference corresponding to a frequency sub-band. For example, the energy difference may include a difference between a tested energy value corresponding to the frequency sub-band and a reference energy value corresponding to the frequency sub-band, e.g., as described below.

In some demonstrative embodiments, acoustic device tester 160 may be configured to determine whether the tested acoustic device 150 meets the predefined testing criterion, for example, based on an amplitude difference corresponding to a frequency sub-band. For example, the amplitude difference may include a difference between a tested amplitude value corresponding to the frequency sub-band and a reference amplitude value corresponding to the frequency sub-band.

In some demonstrative embodiments, the reference profile may define a threshold corresponding to the frequency sub-band, e.g., as described below.

In some demonstrative embodiments, acoustic device tester 160 may be configured to determine that the tested acoustic device 150 fails to meet the predefined testing criterion, for example, based on a determination that the energy difference corresponding to the frequency sub-band is greater than the threshold corresponding to the frequency sub-band, e.g., as described below.

In some demonstrative embodiments, the reference profile may include threshold information defining a plurality of thresholds corresponding to the plurality of frequency sub-bands, e.g., as described below.

In some demonstrative embodiments, acoustic device tester 160 may be configured to determine a plurality of difference values, e.g., energy differences, amplitude differences, and/or any other differences, corresponding to the plurality of frequency sub-bands, respectively. For example, a difference value, e.g., an energy difference or an amplitude difference, corresponding to a frequency sub-band may include a difference between a tested value, e.g., a tested energy value or an tested amplitude value, corresponding to the frequency sub-band and a reference value, e.g., a reference energy value or a reference amplitude value, corresponding to the frequency sub-band, e.g., as described below.

In some demonstrative embodiments, acoustic device tester 160 may be configured to determine whether or not the tested acoustic device 150 meets the predefined testing criterion, for example, based on the plurality of difference values and the plurality of thresholds, e.g., as described below.

In some demonstrative embodiments, the plurality of thresholds may include a first threshold corresponding to a first frequency sub-band, and a second threshold corresponding to a second frequency sub-band. For example, the second threshold may be different from the first threshold, e.g., as described below.

In some demonstrative embodiments, the plurality of thresholds may include a third threshold corresponding to a third frequency sub-band. For example, the third threshold may be equal to the first threshold or the second threshold, e.g., as described below.

In some demonstrative embodiments, the threshold information may define a first threshold value to be set for a first plurality of thresholds corresponding to a first plurality of frequency sub-bands in a first frequency range, and/or a second threshold value, e.g., different from the first threshold value, to be set for a second plurality of thresholds corresponding to a second plurality of frequency sub-bands in a second frequency range, e.g., as described below.

In some demonstrative embodiments, acoustic device tester 160 may be configured to determine that the tested acoustic device 150 fails to meet the predefined testing criterion, for example, based on a determination that, for at least one particular frequency sub-band, a difference value, e.g., an energy difference or an amplitude difference, corresponding to the particular frequency sub-band is greater than a threshold corresponding to the particular frequency sub-band, e.g., as described below.

In some demonstrative embodiments, acoustic device tester 160 may be configured to determine that the tested acoustic device 150 meets the predefined testing criterion, for example, based on a determination that, e.g., for each particular frequency sub-band a difference value, e.g., an energy difference or an amplitude difference, corresponding to the particular frequency sub-band is not greater than a threshold corresponding to the particular frequency sub-band, e.g., as described below.

In some demonstrative embodiments, acoustic device tester 160 may be configured to select the reference profile from a plurality of a reference profiles, for example, based on at least one attribute corresponding to the tested acoustic device 150, e.g., as described below.

In some demonstrative embodiments, the plurality of reference profiles may include a first reference profile defining a first plurality of reference values, e.g., reference energy values and/or reference amplitude values, and/or a second reference profile defining a second plurality of reference values, e.g., reference energy values and/or reference amplitude values. For example, the first plurality of reference values may be different from the second plurality of reference values, e.g., as described below.

In some demonstrative embodiments, the at least one attribute corresponding to the tested acoustic device 150 may include a sensor/transducer attribute defining whether the tested acoustic device is an acoustic sensor or an acoustic transducer, e.g., as described below.

In some demonstrative embodiments, the at least one attribute corresponding to the tested acoustic device 150 may include an assembly-configuration attribute defining a configuration of an assembly of the tested acoustic device in a tested device or system, e.g., as described below.

In some demonstrative embodiments, the at least one attribute corresponding to the tested acoustic device 150 may include any other additional or alternative attribute.

In some demonstrative embodiments, acoustic device tester 160 may be configured to determine the plurality of reference energy values based, for example, on reference acoustic information of a reference acoustic device, which meets the predefined testing criterion, e.g., as described below.

In some demonstrative embodiments, the tested acoustic device 150 may include acoustic transducer. For example, the input acoustic information of the tested acoustic device 150 may be based on an output signal of an acoustic sensor subject to an acoustic signal output by the acoustic transducer, e.g., as described below.

In some demonstrative embodiments, the tested acoustic device 150 may include an acoustic sensor. For example, the input acoustic information of the tested acoustic device 150 may be based on an output signal of the acoustic sensor, e.g., as described below.

In some demonstrative embodiments, acoustic device tester 160 may be configured to process input acoustic information corresponding to acoustic signals communicated between the tested acoustic device 150 and a plurality of other acoustic devices, for example, to determine a plurality of tested acoustic value distributions, e.g., including and/or representing acoustic transfer functions, acoustic spectrums, and/or acoustic signals, corresponding to a respective plurality of combinations of the tested acoustic device with the plurality of other acoustic devices, e.g., as described below.

In some demonstrative embodiments, acoustic device tester 160 may be configured to determine a plurality of test results for the plurality of tested acoustic transfer functions, e.g., as described below.

In some demonstrative embodiments, a test result for a particular tested acoustic transfer function may be based on tested values, e.g., tested energy values, tested amplitude values and/or any other tested values, of the particular tested acoustic transfer function and a reference profile for the particular tested acoustic transfer function, e.g., as described below.

In some demonstrative embodiments, acoustic device tester 160 may be configured to determine whether or not the tested acoustic device 150 meets the predefined testing criterion, for example, based on the plurality of test results, e.g., as described below.

In some demonstrative embodiments, acoustic device tester 160 may be configured to determine a tested value, e.g., a tested energy value, a tested amplitude value and/or any other tested value, for a frequency sub-band, for example, based on a function, e.g., a sum and/or any other function, of acoustic values, e.g., energy values, amplitude values and/or any other acoustic values, in the frequency sub-band, e.g., as described below.

In some demonstrative embodiments, acoustic device tester 160 may be configured to determine whether or not the tested acoustic device 150 meets a runtime testing criterion relating to runtime conditions during operation of a device including the tested acoustic device. For example, the input acoustic information of the tested acoustic device 150 may include runtime acoustic information at the runtime conditions, e.g., as described below.

In some demonstrative embodiments, acoustic device tester 160 may be configured to determine whether or not the tested acoustic device meets an End of Line (EOL) testing criterion relating to EOL conditions at an EOL manufacturing process of the tested acoustic device 150. For example, the input acoustic information of the tested acoustic device 150 may include EOL acoustic information at the EOL conditions, e.g., as described below.

In some demonstrative embodiments, acoustic device tester 160 may be configured to determine whether or not the tested acoustic device meets a post-assembly testing criterion relating to post-assembly conditions of the tested acoustic device assembled in a device. For example, the input acoustic information of the tested acoustic device 150 may include post-assembly acoustic information at the post-assembly conditions, e.g., as described below.

In some demonstrative embodiments, acoustic device tester 160 may be configured to determine an AVD of the acoustic device 150, for example, based on acoustic information corresponding to the acoustic device 150, for example, as received via input 192, e.g., as described below.

In some demonstrative embodiments, acoustic device tester 160 may be configured to determine an acoustic transfer function of the acoustic device 150, for example, based on acoustic information corresponding to the acoustic device 150, for example, as received via input 192, e.g., as described below.

In some demonstrative embodiments, the acoustic value distribution, e.g., the acoustic transfer function, of the acoustic device 150 may represent spectral acoustic characteristics of the acoustic device 150, e.g., as described below.

In some demonstrative embodiments, the acoustic value distribution, e.g., the acoustic transfer function, of the acoustic device 150 may represent signal energy characteristics of the acoustic device 150, e.g., as described below.

In some demonstrative embodiments, the AVD, e.g., the acoustic transfer function, of the acoustic device 150 may include, or may be in the form of, an acoustic energy function, or an acoustic energy spectrum, which may represent acoustic energy characteristics corresponding to the acoustic device 150, e.g., as described below.

In some demonstrative embodiments, the AVD, e.g., the acoustic transfer function, of the acoustic device 150 may include, or may be in the form of, an acoustic spectrum corresponding to acoustic device 150.

For example, for an acoustic sensor device 150, the acoustic value distribution, e.g., the acoustic transfer function, of the acoustic sensor device 150 may include, or may be in the form of, an acoustic spectrum corresponding to an output signal of the acoustic sensor device 150, e.g., as described below.

In some demonstrative embodiments, the acoustic value distribution, e.g., the acoustic transfer function, of the acoustic device 150 may include, or may be in the form of, an acoustic spectrum corresponding to a transfer function of acoustic device 150.

For example, for an acoustic transducer device 150, the acoustic value distribution, e.g., the acoustic transfer function, of the acoustic transducer device 150 may include, or may be in the form of, an acoustic spectrum corresponding to a transfer function, e.g., a speaker transfer function, between the acoustic transducer device 150 and an acoustic sensor to generate acoustic information based on acoustic energy generated by the acoustic transducer device 150, e.g., as described below.

In some demonstrative embodiments, acoustic device tester 160 may be configured to convert the acoustic information of the acoustic device 150 into an acoustic value distribution, e.g., an acoustic transfer function, in a plurality of frequency sub-bands, e.g., as described below.

In some demonstrative embodiments, the acoustic information of the acoustic device 150 may, for example, include, or may be based on, samples of an output signal of the acoustic device 150, for example, when acoustic device 150 includes an acoustic sensor device. According to these embodiments, acoustic device tester 160 may be configured to convert the acoustic information of the acoustic sensor device 150 into the AVD, e.g., the acoustic transfer function, in the plurality of frequency sub-bands, for example, by converting the acoustic spectrum of the output signal of the acoustic sensor device 150 into the AVD, e.g., the acoustic transfer function, in the plurality of frequency sub-bands, e.g., as described below.

In some demonstrative embodiments, the acoustic information of the acoustic device 150 may, for example, include, or may be based on, samples of an output signal of an acoustic sensor device, for example, when acoustic device 150 includes an acoustic transducer device. For example, the acoustic information of the acoustic transducer device 150 may include a transfer function, e.g., a speaker transfer function, between the acoustic transducer device 150 and the acoustic sensor device. According to these embodiments, acoustic device tester 160 may be configured to convert the acoustic information of the acoustic transducer device 150 into the AVD, e.g., the acoustic transfer function, in the plurality of frequency sub-bands, for example, by converting the acoustic information into a transfer function, e.g., a speaker transfer function, in the plurality of frequency sub-bands, e.g., as described below.

In some demonstrative embodiments, the plurality of frequency sub-bands may include ⅓-octave sub-bands, e.g., as described below.

In other embodiments, the plurality of frequency sub-bands may include any other sub-bands of any other octave order.

In some demonstrative embodiments, the plurality of frequency sub-bands may include at least five ⅓-octave sub-bands, e.g., as described below.

In some demonstrative embodiments, the plurality of frequency sub-bands may include eighteen ⅓-octave sub-bands, e.g., as described below.

In other embodiments, the plurality of frequency sub-bands may include any other number of ⅓-octave sub-bands, e.g., less than eighteen ⅓-octave sub-bands or more than eighteen ⅓-octave sub-bands.

In some demonstrative embodiments, the plurality of frequency sub-bands may include 18 or more frequency sub-bands having one or more, e.g., some or all, of the following set of central frequencies, respectively: [19.68, 24.80, 31.25, 39.37, 49.6, 62.5, 78.74, 99.21, 125, 157.49, 198.42, 250, 314.98, 396.85, 500, 629.96, 793.7, 1000, . . . , Fs/2] Hertz (Hz), wherein Fs denotes a sampling frequency.

In other embodiments, the plurality of frequency sub-bands may include any other frequency sub-bands having any other additional or alternative central frequencies.

In other embodiments, the plurality of frequency sub-bands may include any other number of frequency sub-bands, e.g., less than or more than 18 sub-bands, according to any other sub-band allocation or scheme.

In some demonstrative embodiments, acoustic device tester 160 may be configured to apply a plurality of bandpass filters to the acoustic information of the acoustic device 150, for example, to convert the acoustic information of the acoustic device 150 into the acoustic value distribution, e.g., the acoustic transfer function, in the plurality of frequency sub-bands, e.g., as described below.

In one example, the plurality of bandpass filters may include 18 band pass filters having 18 respective central frequencies corresponding to the central frequencies of the 18⅓-octave sub-bands, e.g., as described below.

Figure 2:
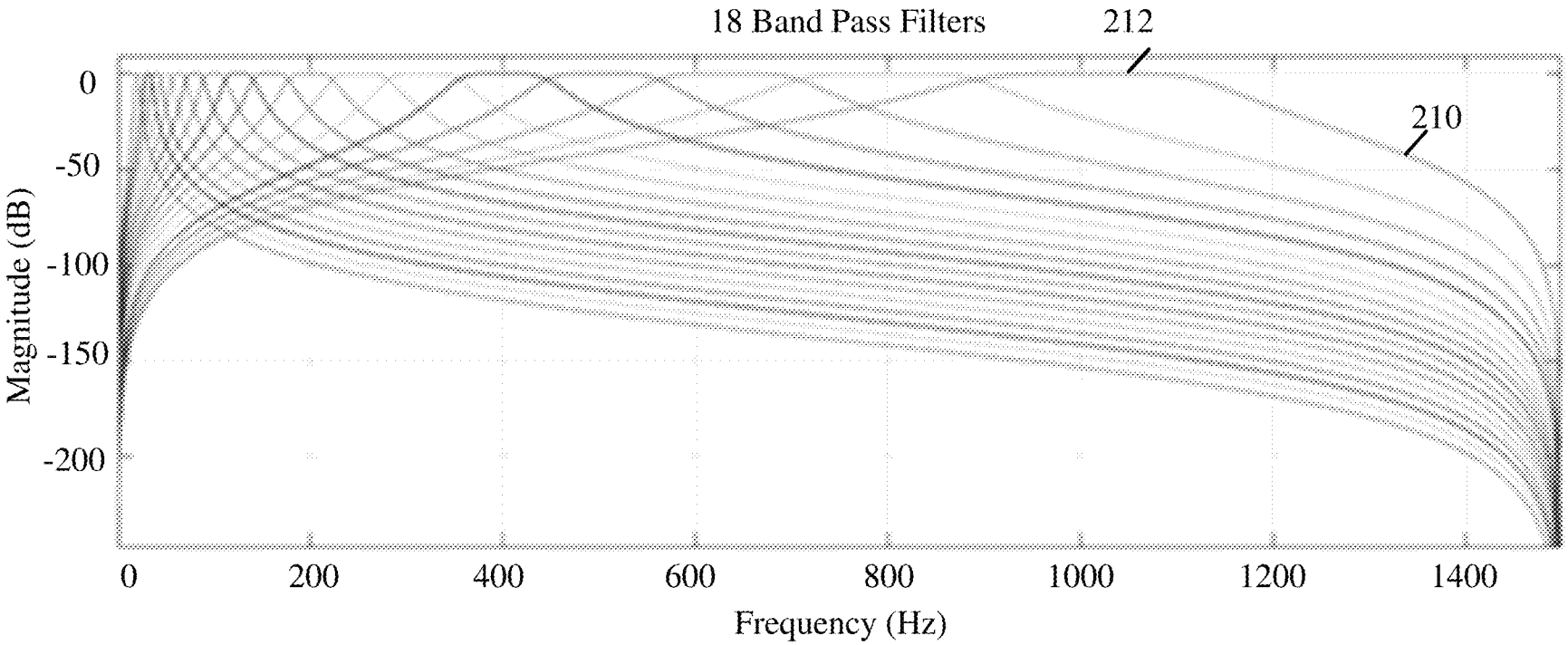
FIG. 2 is a schematic illustration of a graph depicting a plurality of bandpass filter curves, in accordance with some demonstrative embodiments.

Reference is made to FIG. 2, which schematically illustrate a graph 200 depicting a plurality of bandpass filter curves 210, in accordance with some demonstrative embodiments.

In one example, as shown in FIG. 2, the plurality of bandpass filter curves 210 may represent 18 bandpass filters having 18 respective central frequencies 212 corresponding, for example, to the central frequencies of the 18⅓-octave sub-bands, e.g., as described above.

In some demonstrative embodiments, a second-order band pass filter may be configured around a central frequency 212. For example, device tester 160 (FIG. 1) may be configured to utilize bandpass filters according to some or all of the bandpass filter curves 210.

In some demonstrative embodiments, acoustic device tester 160 (FIG. 1) may be configured to generate an acoustic value distribution, e.g., an acoustic transfer function, corresponding to input acoustic information, for example, based on the bandpass filter curves 210, e.g., as described below.

In some demonstrative embodiments, the input acoustic information to be processed by the bandpass filters may include input acoustic information of a tested acoustic device 150 (FIG. 1), e.g., as described below.

According to these embodiments, the acoustic value distribution, e.g., the acoustic transfer function, may include an acoustic value distribution, e.g., an acoustic transfer function, corresponding to the tested acoustic device 150 (FIG. 1), e.g., as described below.

In some demonstrative embodiments, the input acoustic information to be processed by the bandpass filters may include reference acoustic information to be used as a reference for testing acoustic device 150 (FIG. 1), e.g., as described below.

According to these embodiments, the acoustic value distribution, e.g., the acoustic transfer function, may include a reference acoustic value distribution, for example, a reference acoustic transfer function, e.g., as described below.

In some demonstrative embodiments, acoustic device tester 160 (FIG. 1) may be configured to convert the input acoustic information into acoustic information in a plurality of frequency sub-bands, for example, by applying to the input acoustic information each of, e.g., some or all of, the Band-Pass Filters defined by curves 210, for example, according to the following method:

$$sos = \begin{bmatrix} b_{01} & b_{11} & b_{21} & 1 & b_{11} & b_{21} \\ b_{02} & b_{12} & b_{22} & 1 & a_{12} & a_{22} \\ \vdots & \vdots & \vdots & \vdots & \vdots & \vdots \\ b_{0L} & b_{1L} & b_{2L} & 1 & a_{1L} & a_{2L} \end{bmatrix}$$

represents the second-order section digital filter $$H(z) = \prod_{k=1}^{L} H_k(z) = \prod_{k=1}^{L} \frac{b_{0k} + b_{1k}z^{-1} + b_{2k}z^{-2}}{1 + a_{1k}z^{-1} + a_{2k}z^{-2}}.$$

In other embodiments, the acoustic information in the plurality of frequency sub-bands may be determined according to any other additional or alternative technique.

In some demonstrative embodiments, acoustic device tester 160 (FIG. 1) may be configured to generate the acoustic value distribution, e.g., the acoustic transfer function, corresponding to the input acoustic information, for example, by determining a plurality of values, e.g., energy values and/or amplitude values, corresponding to the plurality of frequency sub-bands, e.g., as described below.

In some demonstrative embodiments, acoustic device tester 160 (FIG. 1) may be configured to generate the AVD, e.g., the acoustic transfer function, corresponding to input acoustic information, for example, by generating a vector (also referred to as "acoustic value distribution vector" or "acoustic transfer function vector") including the plurality of energy values corresponding to the plurality of frequency sub-bands, e.g., as described below.

Figure 3:
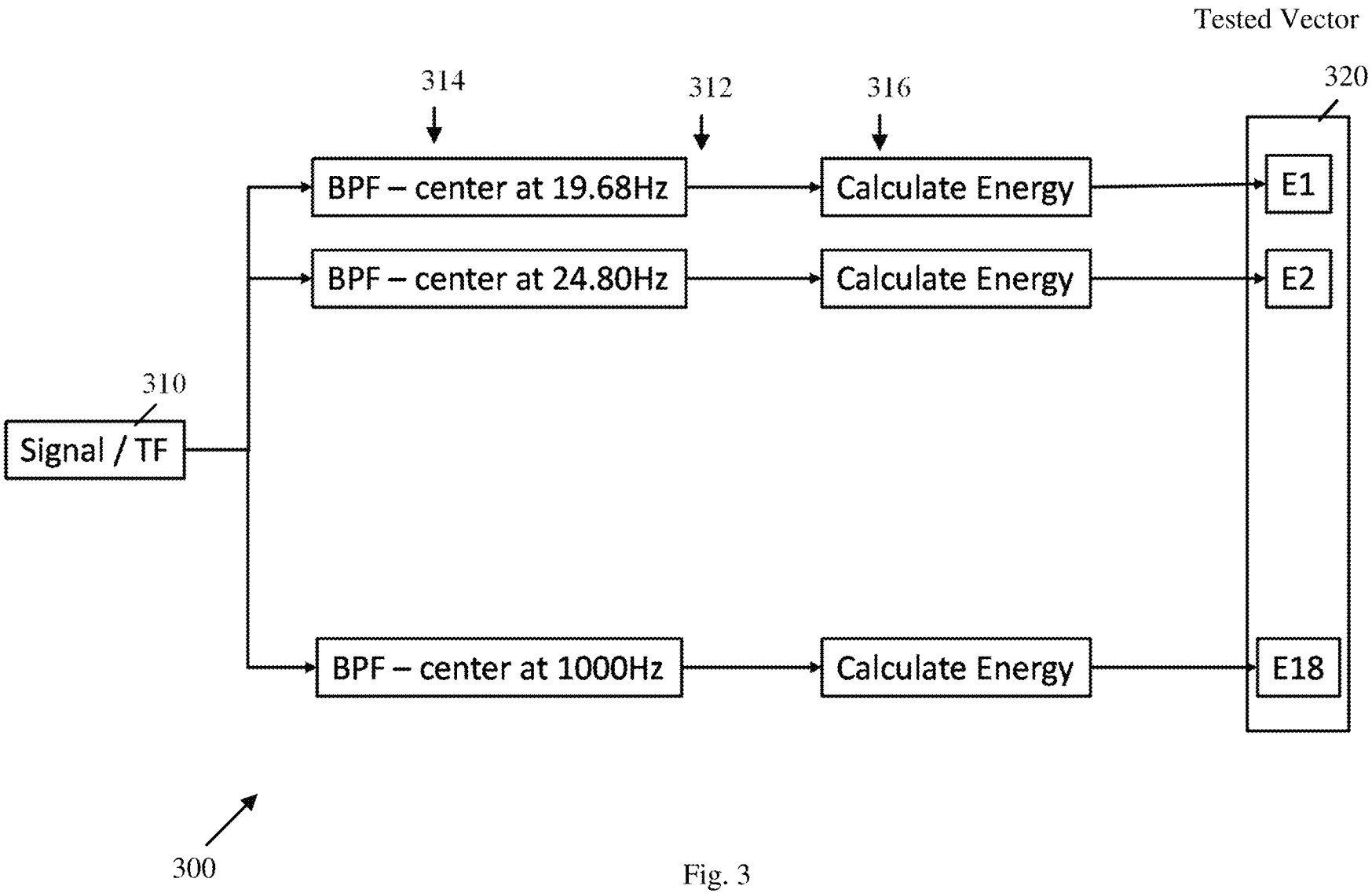
FIG. 3 is a schematic illustration of a conversion scheme to convert input acoustic information into an Acoustic Value Distribution (AVD) over a plurality of frequency bands, in accordance with some demonstrative embodiments.

Reference is made to FIG. 3, which schematically illustrate a conversion scheme 300 to convert input acoustic information 310 into an acoustic value distribution 320, e.g., an acoustic transfer function, over a plurality of frequency sub-bands, in accordance with some demonstrative embodiments. For example, an acoustic device tester, e.g., acoustic device tester 160 (FIG. 1), may be configured to convert input acoustic information 310 into the acoustic value distribution 320 over the plurality of frequency sub-bands, e.g., as described below.

In some demonstrative embodiments, the input acoustic information 310 may include samples of an output signal of an acoustic sensor device, for example, when a tested acoustic device, e.g., acoustic device 150 (FIG. 1), includes an acoustic sensor device, e.g., as described below.

In some demonstrative embodiments, the input acoustic information 310 may include a transfer function (TF), e.g., a speaker transfer function, based on samples of an output signal of an acoustic sensor device, for example, when a tested acoustic device, e.g., acoustic device 150 (FIG. 1), includes an acoustic transducer device, e.g., as described below.

In some demonstrative embodiments, the input acoustic information 310 may include input acoustic information of a tested acoustic device 150 (FIG. 1), e.g., as described below. According to these embodiments, the acoustic value distribution 320 may include an acoustic transfer function (also referred to as "tested vector") corresponding to the tested acoustic device 150 (FIG. 1), e.g., as described below.

In some demonstrative embodiments, the input acoustic information 310 may include reference acoustic information to be used as a reference for testing acoustic device 150 (FIG. 1), e.g., as described below. According to these embodiments, the acoustic value distribution 320 may include a reference acoustic transfer function (also referred to as "reference vector"), e.g., as described below.

In some demonstrative aspects, as shown in FIG. 3, the input acoustic information 310 may be converted into a plurality of frequency sub-bands, e.g., ⅓-octave sub-bands 312, for example, by applying to the input acoustic information 310 a plurality of band pass filters 314 defined according to plurality of ⅓-octave sub-bands 312. For example, the plurality of band pass filters 314 may be defined according to the plurality of band pass filter curves 210 (FIG. 2).

In some demonstrative embodiments, as shown in FIG. 3, a plurality of values 316, e.g., energy values and/or amplitude values, may be determined corresponding to the plurality of ⅓-octave sub-bands 312, respectively. For example, a value 316 corresponding to a ⅓-octave sub-band 312 may be determined as a function of, e.g., based on a sum of, acoustic values, e.g., acoustic energy values and/or acoustic amplitude values in the ⅓-octave sub-band 312.

In some demonstrative embodiments, the acoustic value distribution 320 may be determined to include a vector including the plurality of values 316 corresponding to plurality of frequency sub-bands 312, for example, after the filtering by the band pass filters 314.

Referring back to FIG. 1, in some demonstrative embodiments, acoustic device tester 160 may be configured to test acoustic device 150, for example, based on input acoustic information corresponding to the acoustic device 150 and a reference acoustic profile, e.g., as described below.

In some demonstrative embodiments, the reference acoustic profile may include a reference value distribution, e.g., a reference transfer function, a reference spectrum and/or a reference signal, in a plurality of frequency sub-bands, e.g., as described below.

In some demonstrative embodiments, the reference value distribution in the plurality of frequency sub-bands may be determined, e.g., by acoustic device tester 160, for example, based on reference acoustic information, which may be obtained, for example, with respect to one or more reference acoustic devices, e.g., as described below.

For example, the reference acoustic profile may be determined according to the conversion scheme 300 (FIG. 3) based on the input acoustic information 310 (FIG. 3) including the reference acoustic information. In one example, the reference acoustic information may correspond to a reference acoustic device, e.g., a calibrated acoustic device, which meets the predefined testing criteria.

In other aspects, the reference value distribution in the plurality of frequency sub-bands may be preconfigured.

In some demonstrative embodiments, the plurality of frequency sub-bands may include a plurality of ⅓-octave sub-bands, e.g., as described below.

In some demonstrative embodiments, the plurality of ⅓-octave sub-bands may include at least five ⅓-octave sub-bands, e.g., as described below.

In some demonstrative embodiments, the plurality of ⅓-octave sub-bands may include eighteen ⅓-octave sub-bands, e.g., as described below.

In other embodiments, any other number and/or configuration of frequency sub-bands may be utilized.

In some demonstrative embodiments, the reference value distribution may include a plurality of reference values, e.g., energy values, amplitude values, and/or any other values, corresponding to the plurality of frequency sub-bands.

For example, a reference value of the plurality of reference values may correspond to a respective frequency sub-band of the plurality of frequency sub-bands, e.g., as described below.

In some demonstrative embodiments, the reference acoustic profile may include threshold information to define a plurality of thresholds corresponding to the plurality of frequency sub-bands. For example, a threshold of the plurality of thresholds may correspond to a receptive sub-band of the plurality of sub-bands.

In some demonstrative embodiments, the threshold information may define a first threshold for one or more first frequency sub-bands of the plurality of frequency sub-bands, and/or a second threshold for one or more other frequency sub-bands of the plurality of frequency sub-bands, e.g., as described below.

In some demonstrative embodiments, the threshold information may define one or more thresholds with respect to at least one cutoff frequency, e.g., as described below.

In some demonstrative embodiments, the cutoff frequency may define one or more first frequency sub-bands, e.g., below the cutoff frequency, and one or more second frequency sub-bands, e.g., above the cutoff frequency.

For example, the threshold information may define a first threshold to be applied to the one or more first frequency sub-bands, and a second threshold to be applied to the one or more second frequency sub-bands, e.g., as described below.

In some demonstrative embodiments, acoustic device tester 160 may be configured to determine a tested acoustic value distribution, e.g., a tested acoustic transfer function, corresponding to acoustic device 150, for example, based on the input acoustic information corresponding to the acoustic device 150, e.g., as described below.

In some demonstrative embodiments, acoustic device tester 160 may be configured to determine the tested acoustic value distribution, e.g., the tested acoustic transfer function, corresponding to acoustic device 150, for example, according to the conversion scheme 300 (FIG. 3) based on the input acoustic information 310 (FIG. 3) including the input acoustic information corresponding to the acoustic device 150.

For example, acoustic device tester 160 may be configured to apply the plurality of bandpass filters 314 (FIG. 3) to the input acoustic information corresponding to the acoustic device 150, and to determine the tested acoustic value distribution, e.g., the tested acoustic transfer function, corresponding to acoustic device 150 to include a plurality of values, e.g., energy values ("the tested energy values"), e.g., the plurality of values 316, which may be determined based on the outputs of the plurality of bandpass filters 314 (FIG. 3).

In some demonstrative embodiments, acoustic device tester 160 may be configured to test the acoustic device 150, for example, based on a comparison between the tested acoustic value distribution, e.g., the tested acoustic transfer function, corresponding to acoustic device 150 and the reference acoustic value distribution, e.g., the reference acoustic transfer function, e.g., as described below.

In some demonstrative embodiments, acoustic device tester 160 may be configured to test the acoustic device 150, for example, based on a comparison between the plurality of tested values, e.g., tested energy values and/or tested amplitude values, corresponding to acoustic device 150 and the plurality of reference values, e.g., reference energy values and/or reference amplitude values, of the reference acoustic value distribution, e.g., the reference acoustic transfer function, for example, according to the threshold information, e.g., as described below.

In some demonstrative embodiments, acoustic device tester 160 may be configured to determine a plurality of difference values, e.g., energy differences and/or amplitude differences, corresponding to the plurality of frequency sub-bands, e.g., as described below.

For example, acoustic device tester 160 may be configured to determine a difference value corresponding to a frequency sub-band, for example, based on a difference between a tested value corresponding to the frequency sub-band and a reference value corresponding to the frequency sub-band, e.g., as described below.

For example, acoustic device tester 160 may be configured to determine an energy difference corresponding to a frequency sub-band, for example, based on a difference between a tested energy value corresponding to the frequency sub-band and a reference energy value corresponding to the frequency sub-band, e.g., as described below.

For example, acoustic device tester 160 may be configured to determine an amplitude difference corresponding to a frequency sub-band, for example, based on a difference between a tested amplitude value corresponding to the frequency sub-band and a reference amplitude value corresponding to the frequency sub-band, e.g., as described below.

In some demonstrative embodiments, acoustic device tester 160 may be configured to determine whether or not the plurality of difference values comply with the plurality of thresholds corresponding to the plurality of frequency sub-bands, e.g., as defined by the threshold information, e.g., as described below.

In some demonstrative embodiments, acoustic device tester 160 may be configured to identify for a frequency sub-band whether or not the difference value corresponding to the frequency sub-band exceeds the threshold corresponding to the frequency sub-band, e.g., as described below.

In some demonstrative embodiments, acoustic device tester 160 may determine that acoustic device 150 is faulty, for example, if, for at least one frequency sub-band, it is detected that the difference value corresponding to the frequency sub-band is greater than the threshold corresponding to the frequency sub-band, e.g., as described below.

In some demonstrative embodiments, acoustic device tester 160 may be configured to test and/or diagnose an acoustic sensor device. The phrase acoustic sensor device, as used herein, may refer to a microphone, an accelerometer, and/or any other sensor configured to sense acoustic energy.

In some demonstrative embodiments, acoustic device 150 may include an acoustic sensor device, e.g., as described below.

In some demonstrative embodiments, acoustic device tester 160 may be configured to test and/or diagnose the acoustic sensor 150, for example, based on an acoustic sensor transfer function (also referred to as a "Microphone Transfer Function (MTF)") of the acoustic sensor 150, e.g., as described below.

In some demonstrative embodiments, acoustic device tester 160 may be configured to determine the MTF of the acoustic sensor 150, for example, by sampling an acoustic output signal of the acoustic sensor 150. For example, the MTF of the acoustic sensor 150 may represent spectral acoustic characteristics of the acoustic sensor 150. For example, the MTF of the acoustic sensor 150 may include, or may be based on, an acoustic spectrum of the acoustic output signal of the acoustic sensor 150.

In some demonstrative embodiments, acoustic device tester 160 may be configured to convert the MTF of the acoustic sensor 150 into an MTF in a plurality of frequency sub-bands, for example, a plurality of ⅓-octave sub-bands, e.g., 18⅓-octave sub-bands and/or any other number of ⅓-octave sub-bands, or any other plurality of frequency sub-bands, e.g., as described below.

For example, acoustic device tester 160 may convert the MTF of the acoustic sensor 150 into the MTF in the plurality of frequency sub-bands, for example, by applying to the MTF of the acoustic sensor 150 the plurality of bandpass filters 314 (FIG. 3), e.g., as described above.

In some demonstrative embodiments, acoustic device tester 160 may be configured to determine a plurality of energies corresponding to the plurality of frequency sub-bands, e.g., as described below.

In some demonstrative embodiments, acoustic device tester 160 may be configured to determine a tested MTF vector based on the plurality of energies and the plurality of frequency sub-bands of the MTF, e.g., as described below.

In some demonstrative embodiments, acoustic device tester 160 may determine the tested MTF vector to include the vector 320 (FIG. 3), which may include the plurality of tested energy values based on the outputs of the plurality of bandpass filters 314 (FIG. 3), e.g., as described above.

In some demonstrative embodiments, acoustic device tester 160 may be configured to test the acoustic sensor 150, for example, based on the tested MTF vector and a reference MTF profile, e.g., as described below.

In some demonstrative embodiments, the reference MTF profile may include a reference MTF, e.g., as described below.

In some demonstrative embodiments, the reference MTF may be defined in a plurality of frequency sub-bands, e.g., the plurality of ⅓-octave sub-bands.

In some demonstrative embodiments, the reference MTF may include a plurality of reference energy values corresponding to the plurality of frequency sub-bands.

For example, a reference energy value of the plurality of reference energy values may correspond to a respective frequency sub-band of the plurality of frequency sub-bands, e.g., as described below.

In some demonstrative embodiments, the reference MTF profile may include threshold information to define a plurality of thresholds corresponding to the plurality of frequency sub-bands. For example, a threshold of the plurality of thresholds may correspond to a receptive sub-band of the plurality of sub-bands.

In some demonstrative embodiments, the threshold information may define a first threshold for one or more first frequency sub-bands of the plurality of frequency sub-bands, and/or a second threshold for one or more other frequency sub-bands of the plurality of frequency sub-bands, e.g., as described below.

In some demonstrative embodiments, the threshold information may define one or more thresholds with respect to at least one cutoff frequency, e.g., as escribed below.

In some demonstrative embodiments, the cutoff frequency may define one or more first frequency sub-bands, e.g., below the cutoff frequency, and/or one or more second frequency sub-bands, e.g., above the cutoff frequency.

For example, the threshold information may define a first threshold to be applied to the one or more first frequency sub-bands, and/or a second threshold to be applied to the one or more second frequency sub-bands, e.g., as described below.

In some demonstrative embodiments, acoustic device tester 160 may be configured to test the acoustic sensor 150, for example, based on a comparison between the tested MTF vector and the reference MTF, e.g., as described below.

In some demonstrative embodiments, acoustic device tester 160 may be configured to test the acoustic sensor 150, for example, based on a comparison between the plurality of tested energies of the tested MTF vector and the plurality of reference energies of the reference MTF, for example, according to the threshold information, e.g., as described below.

In some demonstrative embodiments, acoustic device tester 160 may determine whether acoustic device 150, e.g., the microphone or the accelerometer, meets predefined testing criteria, e.g., whether or not the acoustic device 150 is faulty, for example, based on a tested energy in a frequency sub-band of the tested MTF vector, a reference energy in the frequency sub-band of the reference MTF, and a threshold defined for the frequency sub-band according to the MTF threshold information, e.g., as described below.

In some demonstrative embodiments, acoustic device tester 160 may determine whether acoustic device 150, e.g., the microphone or the accelerometer, meets predefined testing criteria, e.g., whether or not the acoustic device 150 is faulty, for example, based on a difference between a tested energy in a frequency sub-band of the tested MTF vector and a reference energy in the frequency sub-band of the reference MTF, e.g., as described below.

In one example, acoustic device tester 160 may determine that acoustic device 150, e.g., the microphone or the accelerometer, is faulty, for example, if a difference between a tested energy in a frequency sub-band of the tested MTF vector and a reference energy in the frequency sub-band of the reference MTF is greater than a threshold defined for the frequency sub-band according to the MTF threshold information.

In another example, acoustic device tester 160 may determine that acoustic device 150, e.g., the microphone or the accelerometer, is not faulty, e.g., that the acoustic device 150 passes the test and/or meets the testing criteria, for example, if a difference between a tested energy in a frequency sub-band of the tested MTF vector and a reference energy in the frequency sub-band of the reference MTF is not greater than a threshold defined for the frequency sub-band according to the MTF threshold information.

For example, acoustic device tester 160 may determine that acoustic device 150, e.g., the microphone or the accelerometer, is not faulty, e.g., that the acoustic device 150 passes the test and/or meets the testing criteria, for example, if, for every frequency sub-band of the tested MTF vector, a difference between a tested energy in the frequency sub-band and a reference energy in the frequency sub-band is not greater than a threshold defined for the frequency sub-band according to the MTF threshold information.

In other embodiments, any other additional or alternative criteria may be defined for determining whether or not acoustic device 150 meets the predefined testing criteria, e.g., whether or not the acoustic device 150 passes the test or is faulty.

In some demonstrative embodiments, acoustic device tester 160 may be configured to test and/or diagnose a plurality of acoustic sensor devices, e.g., a plurality of microphones, accelerometers and/or the like.

In one example, acoustic devices 150 may include the plurality of acoustic sensor devices, e.g., as described below.

In some demonstrative embodiments, acoustic device tester 160 may be configured to check and/or diagnose the plurality of acoustic sensor devices, for example, based on a plurality of tested MTF vectors corresponding to the plurality of acoustic sensor devices, e.g., as described below.

In some demonstrative embodiments, acoustic device tester 160 may be configured to test the plurality of acoustic sensor devices, for example, by comparing each tested MTF vector with a reference MTF, for example, according to threshold information corresponding to the reference MTF, e.g., as described below.

Figure 4:
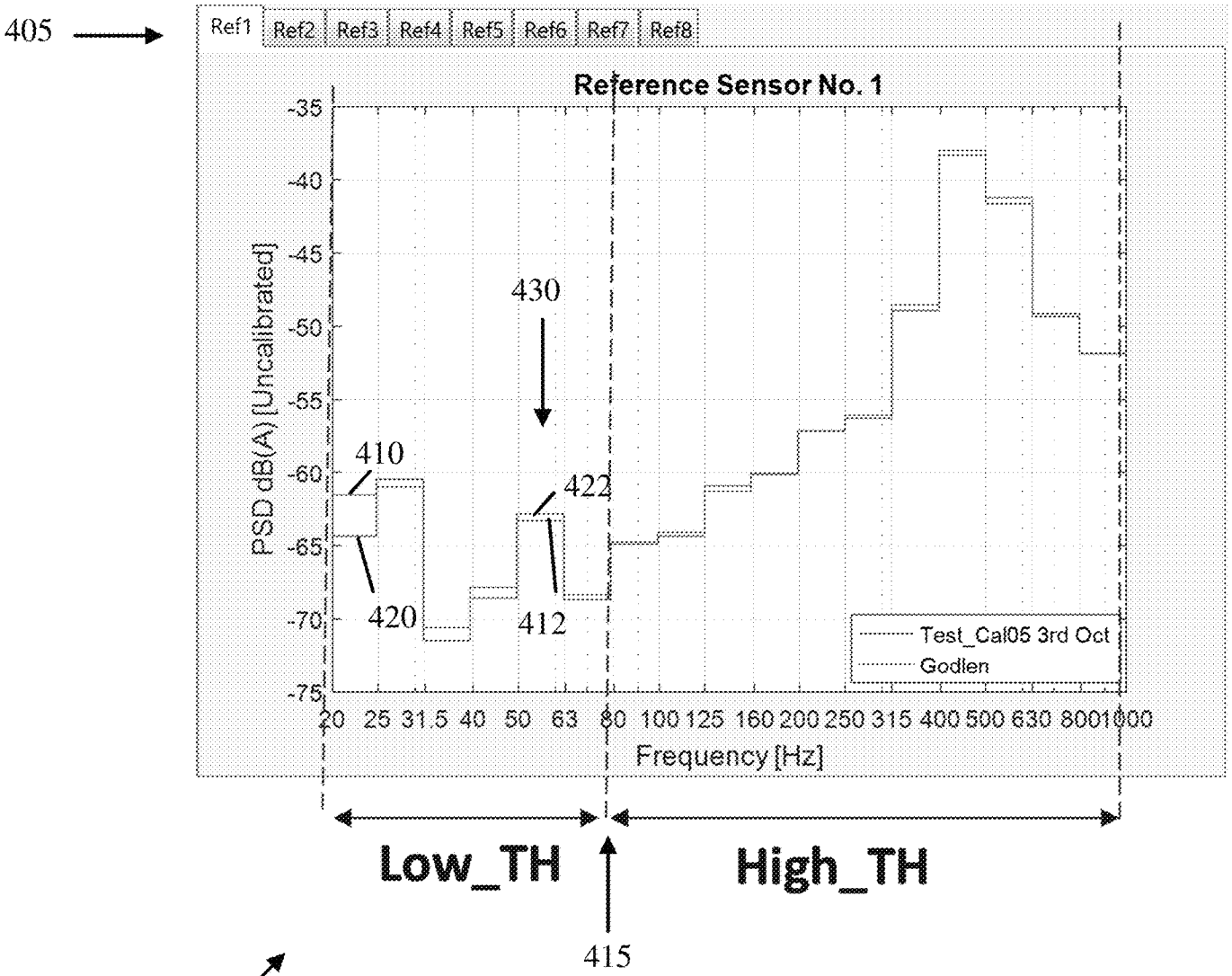
FIG. 4 is a schematic illustration of a graph depicting a reference microphone AVD and a tested AVD, in accordance with some demonstrative embodiments.

Reference is made to FIG. 4, which schematically illustrates a graph 400 depicting a reference AVD (e.g., MTF) 410 and a tested AVD (e.g., MTF) 420, in accordance with some demonstrative embodiments. For example, reference AVD 410 may include a golden AVD, e.g., as described below.

In one example, acoustic device tester 160 (FIG. 1) may be configured to test a plurality of acoustic sensor devices 405, e.g., 8 acoustic sensor devices or any other number of acoustic sensor devices, for example, by comparing each tested AVD, e.g., each tested AVD (e.g., MTF) 420 corresponding to a respective acoustic sensor 405, with the reference MTF 410, for example, according to AVD (e.g., MTF) threshold information for the reference AVD (e.g., MTF) 410, e.g., as described below.

In some demonstrative embodiments, as shown in FIG. 4, the threshold information may define a cutoff frequency 415, e.g., of 80 Hz or any other cutoff frequency, under which a first threshold, denoted low_TH, may be used, and/or above which a second threshold, denoted high_TH, may be used.

In one example, acoustic device tester 160 (FIG. 1) may determine that an acoustic sensor device, is faulty, for example, if a difference between an energy value 422 of the tested AVD (e.g., MTF) vector 420 in a frequency sub-band 430, e.g., between 50-63 Hz, and a reference energy 412 of the reference AVD (e.g., MTF) function 410 in the frequency sub-band 430 is greater than the first threshold.

In one example, acoustic device tester 160 (FIG. 1) may determine that an acoustic sensor device, is faulty, for example, if a difference between an energy value of the tested AVD (e.g., MTF) vector 420 in a frequency sub-band above the cutoff threshold 415 and a reference energy of the reference AVD (e.g., MTF) function 410 in the frequency sub-band above the cutoff threshold 415 is greater than the second threshold.

In some demonstrative embodiments, reference AVD (e.g., MTF) function 410 may be determined, for example, based on a plurality of tested AVD (e.g., MTF) vectors, e.g., of a plurality of tested acoustic sensors.

In some demonstrative embodiments, reference AVD (e.g., MTF) function 410 may be determined, for example, based on a median of the plurality of tested AVD (e.g., MTF) vectors, e.g., as described below.

In other embodiments, reference AVD (e.g., MTF) function 410 may be determined based on any other function and/or combination of the plurality of tested AVD (e.g., MTF) vectors.

Figure 5:
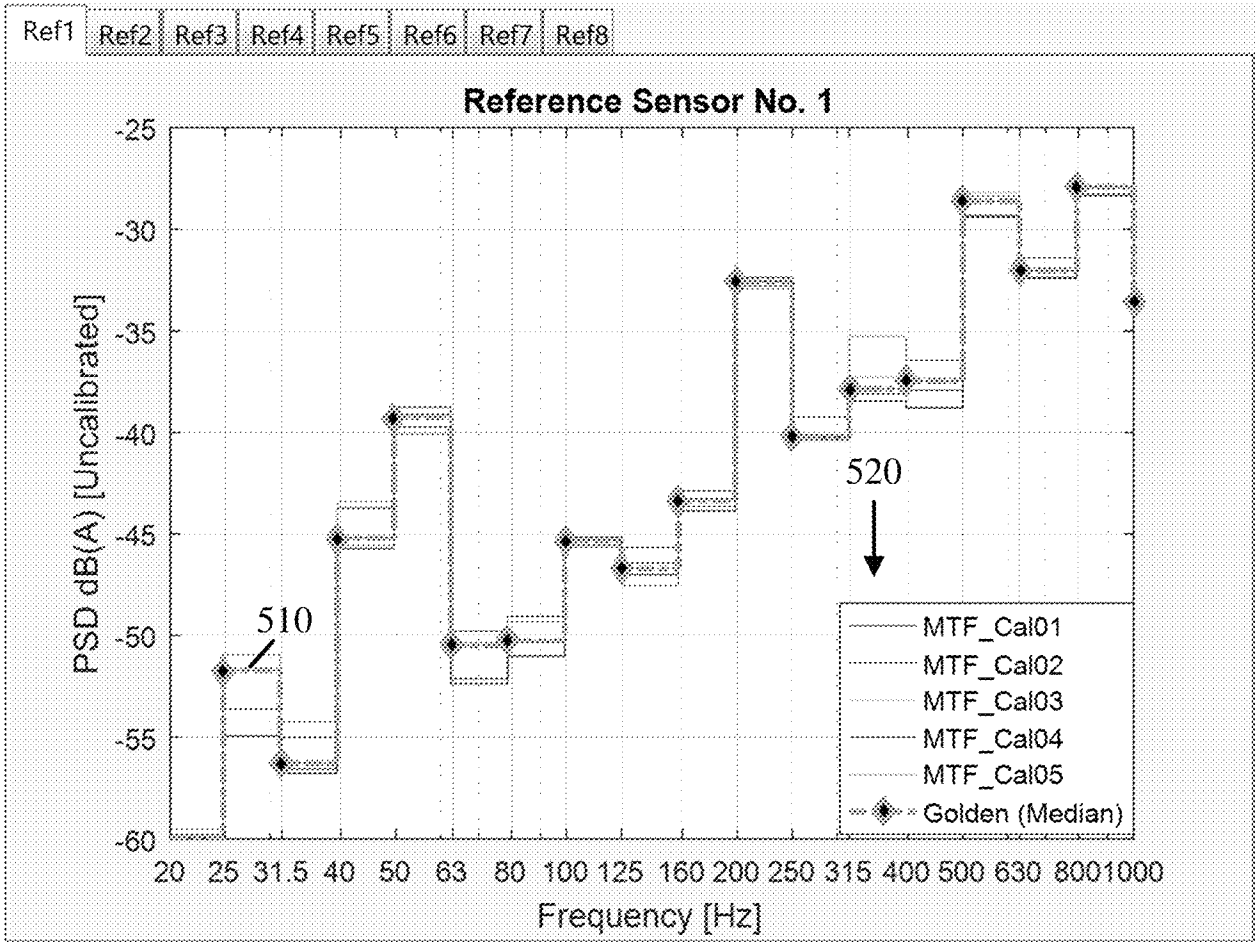
FIG. 5 is a schematic illustration of a graph depicting a reference AVD based on a median of a plurality of AVDs, in accordance with some demonstrative embodiments.

Reference is made to FIG. 5, which schematically illustrates a graph 500 depicting a median 510 of a plurality of tested AVDs (e.g., MTF vectors) 520, in accordance with some demonstrative embodiments In one example, the plurality of AVDs (e.g., MTF vectors) 520 may be based on measurements of acoustic signals a respective plurality of acoustic sensor devices, e.g., a plurality of "calibration" acoustic sensor devices which may be used to calibrate the reference AVD (e.g., MTF).

Referring back to FIG. 1, in some demonstrative embodiments, acoustic device tester 160 may use median 510 (FIG. 5), for example, as a reference AVD and/or MTF, e.g., reference AVD and/or MTF 410 (FIG. 4).

In one example, acoustic device tester 160 may perform one or more operations to determine and/or calibrate a reference AVD and/or MTF profile, e.g., by performing one or more of the following operations:

Analyze all references and monitoring signals spectra in ⅓-octave, e.g., of the sensor acoustic devices.

Benchmark signals spectra of all the sensor acoustic devices to form a predefined reference AVD and/or MTF.

Set a Failure criteria to +/−TH (dB) per ⅓-octave band for each reference and monitoring signal spectra.

The Failure Criteria may be divided to two frequency bands, or any other number of frequency bands, e.g., as follows:

Low_TH(<F[Hz]) dB

High_TH(>F[Hz]) dB

Construct the predefined AVD and/or MTF reference as the Median of each ⅓-octave band from a final set of measurements data for each reference or monitoring sensor.

In other embodiments, acoustic device tester 160 may perform any other additional or alternative operations to determine the reference AVD and/or MTF profile.

In one example, acoustic device tester 160 may perform one or more operations to determine whether or not an acoustic sensor device 150 meets testing criteria, e.g., whether or not an acoustic sensor device 150 is faulty, for example, based on a tested AVD and/or MTF vector of the acoustic sensor device, and a reference AVD and/or MTF, e.g., as follows:

Input each <MTF(k)> and <MTF(l)> into the <Signal2OctaveEnergy> function.

The function returns array of energies at frequencies at the ⅓-octave bands of:

[19.68, 24.80, 31.25, 39.37, 49.6, 62.5, 78.74, 99.21, 125, 157.49, 198.42, 250, 314.98, 396.85, 500, 629.96, 793.7, 1000 Hz, . . . , Fs/2].

Load the Reference <MTF(k)> energy.

If exist a bin, or several bins, e.g., a sub-band, with energy, value and/or amplitude difference at the cutoff ⅓-octave band frequency (F) greater than Low_TH (dB) and/or High_TH (dB) mark the acoustic sensor device as faulty.

In some demonstrative embodiments, acoustic device tester 160 may be configured to test and/or diagnose an acoustic transducer device. The term "acoustic transducer device" as used herein may relate to a speaker, an acoustic actuator, a headphone, and/or any other acoustic device configured to generate acoustic energy.

In some demonstrative embodiments, acoustic device 150 may include an acoustic transducer device, e.g., as described below.

In some demonstrative embodiments, acoustic device tester 160 may be configured to test and/or diagnose the acoustic transducer device 150, for example, based on an acoustic transducer transfer function (also referred to as a "Speaker Transfer Function (STF)") of the acoustic device 150, e.g., as described below.

In some demonstrative embodiments, acoustic device tester 160 may be configured to estimate the STF of the acoustic transducer device 150, e.g., as described below.

In some demonstrative embodiments, acoustic device tester 160 may be configured to estimate the STF of the acoustic transducer device 150, for example, based on an input signal to acoustic transducer device 150, e.g., as described below.

In some demonstrative embodiments, acoustic device tester 160 may be configured to apply the input signal to acoustic transducer device 150, and to record, e.g., by an acoustic sensor device, an output signal of the acoustic transducer device 150, e.g., as described below.

In some demonstrative embodiments, acoustic device tester 160 may be configured to estimate the STF of the acoustic transducer device 150, for example, based on the input signal and an output signal of the acoustic sensor device sensing the output of the acoustic device 150, e.g., as described below.

In some demonstrative embodiments, acoustic device tester 160 may be configured to estimate the STF of the acoustic transducer device 150, for example, by performing a cross correlation between the input signal of the acoustic device 150 and the output signal of the acoustic sensor device sensing the output of the acoustic device 150, e.g., as described below.

In some demonstrative embodiments, acoustic device tester 160 may be configured to convert the STF of the acoustic transducer device 150 into an STF in a plurality of frequency sub-bands, for example, the plurality of ⅓-octave sub-bands, e.g., as described above.

In some demonstrative embodiments, acoustic device tester 160 may be configured to determine a plurality of test energies of the STF of the acoustic transducer device 150 corresponding to the plurality of frequency sub-bands, e.g., as described above.

In some demonstrative embodiments, acoustic device tester 160 may be configured to determine a tested STF vector of the acoustic transducer device 150, for example, based on the plurality of test energies and the plurality of frequency sub-bands, e.g., as described below.

In some demonstrative embodiments, acoustic device tester 160 may be configured to test the acoustic transducer device 150, for example, based on the tested STF vector, and a reference STF profile, e.g., as described below.

In some demonstrative embodiments, the reference STF profile may include a reference STF, e.g., as described below.

In some demonstrative embodiments, the reference STF may be in a plurality of frequency sub-bands, e.g., the plurality of ⅓-octave sub-bands, e.g., as described below.

In some demonstrative embodiments, the reference STF may define a plurality of reference energies corresponding to the plurality of frequency sub-bands. For example, a reference energy may correspond to a respective frequency sub-band of the plurality of frequency sub-bands of the reference STF, e.g., as described below.

In some demonstrative embodiments, the reference STF profile may include STF threshold information to define a plurality of thresholds corresponding to the plurality of frequency sub-bands of the reference STF, e.g., as described below.

In some demonstrative embodiments, a threshold may correspond to a receptive sub-band of the plurality of sub-bands, e.g., as described below.

In some demonstrative embodiments, acoustic device tester 160 may be configured to test the acoustic transducer device 150, for example, based on a comparison between the tested STF vector and the reference STF, e.g., as described below.

In some demonstrative embodiments, acoustic device tester 160 may be configured to test the acoustic transducer device 150, for example, based on a comparison between the plurality of energies of the tested STF vector and the plurality of reference energies of the reference STF, e.g., as described below.

In some demonstrative embodiments, acoustic device tester 160 may be configured to test the acoustic device 150, for example, based on a comparison between the plurality of tested energies of the tested STF vector and the plurality of reference energies of the reference STF, for example, according to the STF threshold information, e.g., as described below.

In some demonstrative embodiments, acoustic device tester 160 may determine whether acoustic transducer device 150 meets predefined testing criteria, e.g., whether or not the acoustic transducer device is faulty, for example, based on a tested energy in a frequency sub-band of the tested STF vector, a reference energy in the frequency sub-band of the reference STF, and a threshold defined for the frequency sub-band according to the STF threshold information, e.g., as described below.

In some demonstrative embodiments, acoustic device tester 160 may determine whether acoustic transducer device 150 meets predefined testing criteria, e.g., whether or not the acoustic transducer device 150 is faulty, for example, based on a difference between a tested energy in a frequency sub-band of the tested STF vector and a reference energy in the frequency sub-band of the reference STF, e.g., as described below.

In one example, acoustic device tester 160 may determine that acoustic transducer device 150, e.g., the speaker, is faulty, for example, if a difference between a tested energy in a frequency sub-band of the tested STF vector and a reference energy in the frequency sub-band of the reference STF is greater than a threshold defined for the frequency sub-band according to the STF threshold information.

In another example, acoustic device tester 160 may determine that acoustic transducer device 150 is not faulty, e.g., that acoustic transducer device 150 passes the test and/or meets the testing criteria, for example, if a difference between a tested energy in a frequency sub-band of the tested STF vector and a reference energy in the frequency sub-band of the reference STF is not greater than a threshold defined for the frequency sub-band according to the STF threshold information.

For example, acoustic device tester 160 may determine that acoustic transducer device 150 is not faulty, e.g., that the acoustic transducer device 150 passes the test and/or meets the testing criteria, for example, if, for every frequency sub-band of the tested STF vector, a difference between a tested energy in the frequency sub-band and a reference energy in the frequency sub-band is not greater than a threshold defined for the frequency sub-band according to the STF threshold information.

In other embodiments, any other additional or alternative criteria may be defined for determining whether or not acoustic transducer device 150 meets the predefined testing criteria, e.g., whether or not the acoustic transducer device 150 passes the test or is faulty.

In some demonstrative embodiments, acoustic device tester 160 may be configured to test and/or diagnose a device and/or system including one or more acoustic transducer devices, for example, a plurality of speakers, headphones and/or the like, and/or one or more acoustic sensors, for example, microphones, accelerometers and/or the like, e.g., as described below.

In some demonstrative embodiments, acoustic device tester 160 may be configured to perform one or more operations to check and/or diagnose the acoustic transducer devices, and/or the acoustic sensor devices, e.g., as described below.

In some demonstrative embodiments, acoustic device tester 160 may be configured to determine a plurality of tested STFs corresponding to a plurality of different combinations between the one or more acoustic transducers and the one or more acoustic sensors.

In one example, the plurality of tested STFs may include a plurality of tested STFs corresponding to an acoustic transducer. For example, the plurality of tested STFs corresponding to the acoustic transducer may correspond to a respective plurality of combinations between the acoustic transducer and a plurality of acoustic sensors, e.g., as described below.

In another example, the plurality of tested STFs may include a plurality of tested STFs corresponding to an acoustic sensor. For example, the plurality of tested STFs corresponding to the acoustic sensor may correspond to a respective plurality of combinations between the acoustic sensor and a plurality of acoustic transducers, e.g., as described below.

In some demonstrative embodiments, acoustic device tester 160 may be configured to determine whether a tested STF meets predefined testing criteria for the STF, e.g., as described below.

In some demonstrative embodiments, acoustic device tester 160 may be configured to determine whether a tested STF is faulty, for example, based on the determination whether the tested STF meets the predefined testing criteria for the STF, e.g., as described below.

In some demonstrative embodiments, acoustic device tester 160 may be configured to determine whether the tested STF meets the predefined testing criteria for the STF, for example, by comparing energy values of the tested STF in a plurality of frequency sub-bands, with a respective plurality of reference energy values in the plurality of frequency sub-bands, and determining whether the tested STF meets the predefined testing criteria for the STF based on threshold information corresponding to the plurality of frequency sub-bands, e.g., as described below.

In some demonstrative embodiments, acoustic device tester 160 may be configured to determine that an acoustic transducer is faulty, for example, if one or more, e.g., some or all, tested STFs corresponding the acoustic transducer fail to meet the predefined testing criteria, e.g., as described below.

In some demonstrative embodiments, acoustic device tester 160 may be configured to determine that the acoustic transducer is faulty, for example, if the STFs corresponding to all combinations of the acoustic transducer device with the plurality of acoustic sensor devices are determined to be faulty, e.g., as described below.

In some demonstrative embodiments, acoustic device tester 160 may be configured to determine that an acoustic sensor is faulty, for example, if one or more, e.g., some or all, tested STFs corresponding the acoustic sensor are determined to be faulty, e.g., as described below.

In some demonstrative embodiments, acoustic device tester 160 may be configured to determine that the acoustic sensor is faulty, for example, if the STFs corresponding to all combinations of the acoustic sensor device with the plurality of acoustic transducer devices are determined to be faulty, e.g., as described below.

In some demonstrative embodiments, acoustic device tester 160 may be configured to perform one or more operations to record output signals from the plurality of acoustic sensor devices, e.g., as follows:

For speaker <m> in range 0 to M−1, transmit signal <In> after <offset*m> taps from the task start Record the monitoring microphone from the task start until the last speaker ends the transmission wherein m denotes a speaker index, <in> denotes a vector of length <N>, e.g., having 2400 taps or any other number of taps, and stored in a memory, e.g., memory 194; <offset> denotes an integer value, e.g., 600 or any other value; and <in_inv> denotes a vector having a length of N taps, stored in the memory.

In some demonstrative embodiments, acoustic device tester 160 may be configured to perform one or more operations to estimate the STF of the plurality of acoustic transducer devices, e.g., as follows:

For speaker <m> and microphone <l>

Take the microphone signal <l> with indexes of transmission of speaker <m>.

Store it to array <in_err>.

Perform the cross-correlation of the <in_err> with <in_inv>

Store it to vector <xc>. Result is a vector of length <N*2−1>.

<STF(m,l)> is equal to <xc> with indexes <N> to <N+STF_length(m,l)>.

Store it to array.

wherein <l> denotes a microphone index, <in_err> denotes the output signal recorded by the microphone l, and <STF (m,l)> denotes the STF between the acoustic transducer device m and the microphone l.

In other embodiments, acoustic device tester 160 may perform one or more additional or alternative operations to estimate the STF between the acoustic transducer device m and the microphone l.

In some demonstrative embodiments, acoustic device tester 160 may be configured to perform one or more operations to convert the STF into a tested STF vector in the plurality of frequency sub-bands, and to compare the tested STF vector with the reference STF, e.g., as follows:

Input each <STF(m,l)> into the <TF2OctaveEnergy> function.

The function returns array of energies at frequencies at the ⅓ octave bands of:

[19.68, 24.80, 31.25, 39.37, 49.6, 62.5, 78.74, 99.21, 125, 157.49, 198.42, 250, 314.98, 396.85, 500, 629.96, 793.7, 1000, . . . , Fs/2,] Hz.

Load the <Golden STF(m,l)> energy. If exist a bin, or several bins, with energy difference, greater than TH(dB), mark the <STF(m,l)> as failed.

wherein <Golden STF(m,l)> denotes the reference STF corresponding to the combination of the acoustic transducer device m and the microphone l.

In other embodiments, acoustic device tester 160 may perform one or more additional or alternative operations to convert the STF into a tested STF vector in the plurality of frequency sub-bands, and/or to compare the tested STF vector with the reference STF.

In some demonstrative embodiments, acoustic device tester 160 may be configured to determine whether or not an acoustic device, e.g., an acoustic transducer or an acoustic sensor, is faulty, e.g., as follows:

For each speaker <m>

If all or above Mfault STF(m,0:L−1)s with speaker <m> is faulty, mark speaker <m> as faulty.

For each microphone <l>

If all or above Lfault STFs(0:M−1,1) with microphone <l> is faulty, mark microphone <l> as faulty.

In one example, acoustic device tester 160 may perform one or more additional or alternative operations to determine whether or not the acoustic device is faulty.

Figure 6:
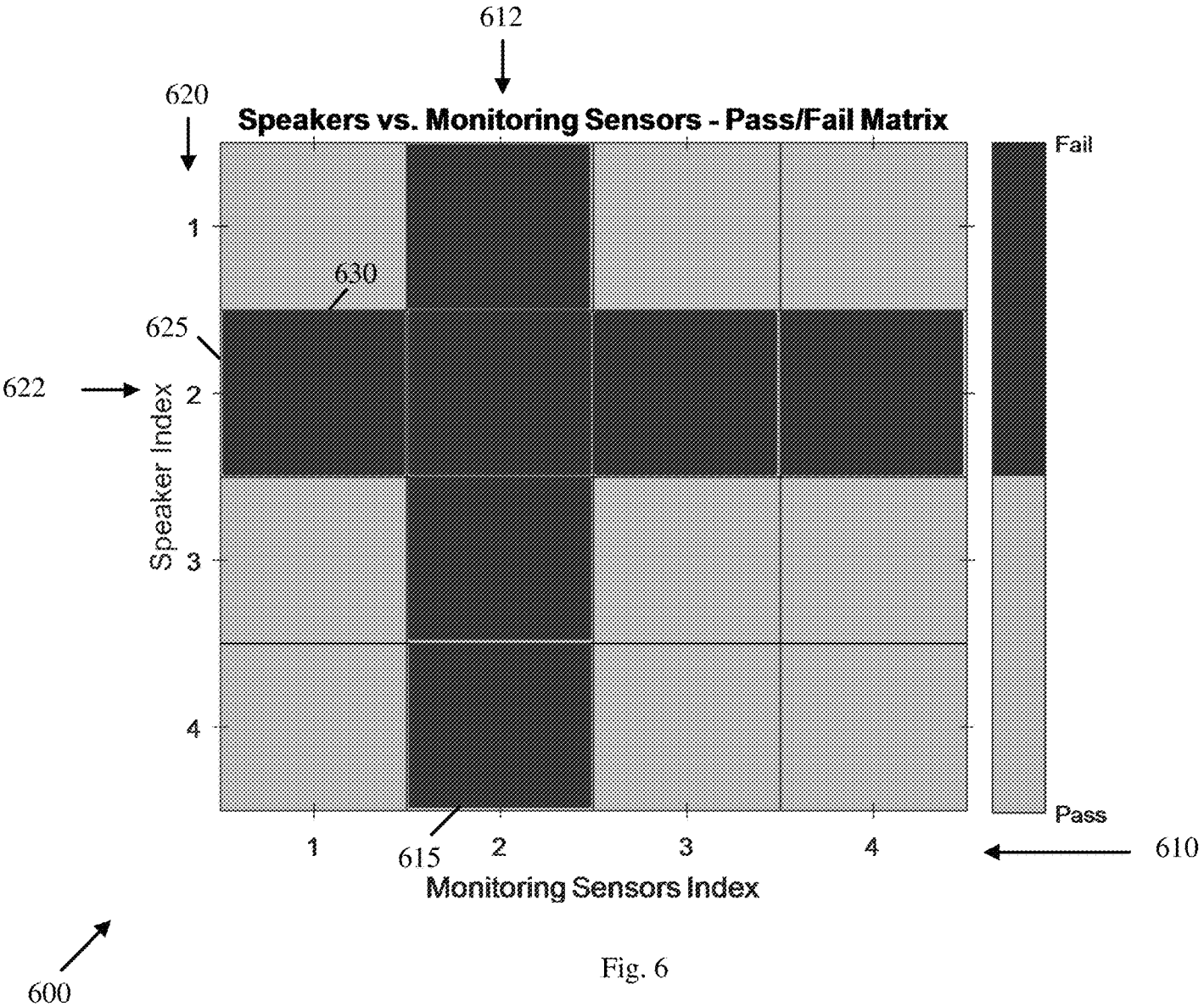
FIG. 6 is a schematic illustration of a graph depicting a fail/pass matrix corresponding to acoustic devices of an acoustic system, in accordance with some demonstrative embodiments.

Reference is made to FIG. 6, which schematically illustrates a fail/pass matrix 600 corresponding to acoustic devices of an acoustic system, in accordance with some demonstrative embodiments.

In some demonstrative embodiments, as shown in FIG. 6, fail/pass matrix 600 may be configured to compare between fail/pass results of a plurality of acoustic sensor devices 610, e.g., including four acoustic sensor devices 610, and/or fail/pass results of a plurality of acoustic transducer devices, e.g., including four acoustic transducer devices 620, e.g., as described below.

In some demonstrative embodiments, acoustic device tester 160 (FIG. 1) may be configured to determine whether or not a tested STF corresponding to a combination 630 including an acoustic sensor device of the plurality of acoustic sensor devices 610 and an acoustic transducer device of the plurality of acoustic transducer devices 620 is determined to be faulty, e.g., as described above.

In some demonstrative embodiments, acoustic device tester 160 (FIG. 1) may be configured to determine that an acoustic sensor device 615 is faulty, for example, if tested STFs of all combinations 612 corresponding to the acoustic sensor device 615 with each of the plurality of acoustic transducer devices 620 are determined to be faulty, e.g., as described below.

In some demonstrative embodiments, acoustic device tester 160 (FIG. 1) may be configured to determine that an acoustic transducer device 625 is faulty, for example, if tested STFs of all combinations 622 corresponding to the acoustic transducer device 625 with each of the plurality of acoustic sensor devices 610 are determined to be faulty, e.g., as described below.

In some demonstrative embodiments, acoustic device tester 160 (FIG. 1) may be configured to determine that an acoustic sensor device, e.g., the acoustic sensor device "1," "3" or "4", is not faulty, for example, if tested STFs of some of the combinations corresponding to the acoustic sensor device with each of the plurality of acoustic transducer devices 620 are determined not to be faulty, e.g., as described below.

In some demonstrative embodiments, acoustic device tester 160 (FIG. 1) may be configured to determine that an acoustic transducer device, e.g., the acoustic transducer device "1", "3" or "4", is not faulty, for example, if tested STFs of some or all combinations corresponding to the acoustic transducer device with each of the plurality of acoustic sensor devices 610 are determined not to be faulty, e.g., as described below.

In some demonstrative embodiments, acoustic device tester 160 (FIG. 1) may be configured to determine whether or not an acoustic device, e.g., an acoustic sensor device 610 and/or an acoustic transducer device 620, is faulty, e.g., according to one or more, e.g., some or all, of the following operations:

Analysis by evaluating all Speaker Transfer Functions (TF's) in the system, i.e. STF11, STF12 etc., e.g., in the ⅓ octave bands.

TF's are benchmarked to a predefined "Golden" Signal, e.g., the reference STF Profile, for the combinations of Speakers and Monitoring sensors.

Failure criteria is set to ±XdB per ⅓ octave band, e.g., for each calculated STF11, STF12 etc.

If entire Row, e.g., row 622, has failed criteria, then the respective speaker status is indicated as malfunctioned.

If entire Column, e.g., column 612, has failed criteria, then the respective Monitoring Sensor status is indicated as malfunctioned In other embodiments, acoustic device tester 160 may perform one or more additional or alternative operations to determine whether or not the acoustic devices are faulty.

Referring back to FIG. 1, in some demonstrative embodiments, acoustic device tester 160 may be configured to test and/or diagnose one or more acoustic devices 150 implemented and/or assembled within a product, a device, and/or a system.

In one example, device 102 may include the one or more acoustic devices 150.

In another example, the device and/or system including the one or more acoustic devices 150 may be separate from device 102.

In some demonstrative embodiments, device 102 and/or the device and/or system including the one or more acoustic devices 150 may include a computing device, a mobile device, or a consumer device, for example, including a plurality of acoustic devices 150, e.g., one or more speakers, one or more microphones, and/or any other acoustic sensor, and/or any other acoustic transducer.

In one example, device 102 and/or the device and/or system including the one or more acoustic devices 150 may include, for example, an audio device, a video device, a multimedia device, a consumer device, a computing device, a Smartphone, a Mobile phone, a cellular telephone, a User Equipment (UE), a computer, a mobile computer, a laptop computer, a notebook computer, a tablet computer, a handheld computer, a sensor device, a handheld device, a wearable device, a consumer device, a vehicular device, a mobile or portable device, a non-mobile or non-portable device, or the like.

In some demonstrative embodiments, device 102 and/or the device and/or system including the one or more acoustic devices 150 may include an Active Acoustic Control (AAC) system, e.g., as described below.

In some demonstrative embodiments, the AAC system may be configured to control acoustic energy and/or wave amplitude of one or more acoustic patterns produced by one or more acoustic sources, which may include known and/or unknown acoustic sources, e.g., as described below.

In some demonstrative embodiments, an AAC system may be configured as, and/or may perform one or more functionalities of, an Active Noise Control (ANC) system, and/or an Active Sound Control (ASC) system, which may be configured to control, reduce and/or eliminate the noise energy and/or wave amplitude of one or more acoustic patterns ("primary patterns") produced by one or more noise sources, which may include known and/or unknown noise sources, e.g., as described below.

In some demonstrative embodiments, an AAC system may be configured to produce an acoustic control pattern (also referred to as "sound control pattern" or "secondary pattern"), e.g., including a destructive noise pattern and/or any other sound control pattern, e.g., as described below.

In some demonstrative embodiments, the AAC system may be configured to generate the acoustic control pattern, for example, based on one or more of the primary patterns, for example, such that a controlled sound zone, for example, a reduced noise zone, e.g., a quiet zone, may be created by a combination of the secondary and primary patterns, e.g., as described below.

In some demonstrative embodiments, the AAC system may be configured to control, reduce and/or eliminate noise within a predefined location, area or zone ("the acoustic control zone", "the noise-control zone", also referred to as the "quiet zone", or "Quiet Bubble™"), without, for example, regardless of, and/or without using a-priori information regarding the primary patterns and/or the one or more noise sources, e.g., as described below.

For example, the AAC system may be configured to control, reduce and/or eliminate noise within the acoustic control zone, e.g., independent of, regardless of and/or without knowing in advance one or more attributes of one or more of the noise sources and/or one or more of the primary patterns, for example, the number, type, location and/or other attributes of one or more of the primary patterns and/or one or more of the noise sources, e.g., as described below.

Some demonstrative embodiments are described herein with respect to AAC systems and/or methods configured to reduce and/or eliminate the noise energy and/or wave amplitude of one or more acoustic patterns within a quiet zone, e.g., as described below.

However, in other embodiments, any other AAC and/or sound control systems and/or methods may be configured to control in any other manner any other acoustic energy and/or wave amplitude of one or more acoustic patterns within an acoustic control zone (sound control zone), for example, to affect, alter and/or modify the sound energy and/or wave amplitude of one or more acoustic patterns within a predefined zone, e.g., as described below.

In one example, the AAC systems and/or methods may be configured to selectively reduce and/or eliminate the acoustic energy and/or wave amplitude of one or more types of acoustic patterns within the acoustic control zone and/or to selectively increase and/or amplify the acoustic energy and/or wave amplitude of one or more other types of acoustic patterns within the acoustic control zone; and/or to selectively maintain and/or preserve the acoustic energy and/or wave amplitude of one or more other types of acoustic patterns within the acoustic control zone, e.g., as described below.

In some demonstrative embodiments, an AAC system may be configured as, and/or may perform or more functionalities of, a sound control system, for example, a personal sound control system (also referred to as a "Personal Sound Bubble (PSB)™ system"), which may be configured to produce a sound control pattern, which may be based on at least one audio input, for example, such that at least one personal sound zone, may be created based on the audio input, e.g., as described below.

In some demonstrative embodiments, the AAC system may be configured to control sound within at least one predefined location, area or zone, e.g., at least one PSB, for example, based on audio to be heard by a user. In one example, the PSB may be configured to include an area around a head and/or ears of the user, e.g., as described below.

In some demonstrative embodiments, the AAC system may be configured to control a sound contrast between one or more first sound patterns and one or more second sound patterns in the PSB, e.g., as described below.

In some demonstrative embodiments, for example, the AAC system may be configured to control a sound contrast between one or more first sound patterns of audio to be heard by the user, and one or more second sound patterns, e.g., as described below.

In some demonstrative embodiments, for example, the AAC system may be configured to selectively increase and/or amplify the sound energy and/or wave amplitude of one or more types of acoustic patterns within the PSB, e.g., based on the audio to be heard in the PSB; to selectively reduce and/or eliminate the sound energy and/or wave amplitude of one or more types of acoustic patterns within the PSB, e.g., based on acoustic signals which are to be reduced and/eliminated; and/or to selectively and/or to selectively maintain and/or preserve the sound energy and/or wave amplitude of one or more other types of acoustic patterns within the PSB, e.g., as described below.

In some demonstrative embodiments, the AAC system may be configured to control the sound within the PSB based on any other additional or alternative input or criterion.

In some demonstrative embodiments, the AAC system may be configured to control, reduce, and/or eliminate the acoustic energy and/or wave amplitude of one or more of the primary patterns within the acoustic control zone.

In some demonstrative embodiments, the AAC system may be configured to control, reduce, and/or eliminate noise within the acoustic control zone in a selective and/or configurable manner, e.g., based on one or more predefined noise pattern attributes, such that, for example, the noise energy, wave amplitude, phase, frequency, direction and/or statistical properties of one or more first primary patterns may be affected by the secondary pattern, while the secondary pattern may have a reduced effect or even no effect on the noise energy, wave amplitude, phase, frequency, direction and/or statistical properties of one or more second primary patterns, e.g., as described below.

In some demonstrative embodiments, the AAC system may be configured to control, reduce and/or eliminate the acoustic energy and/or wave amplitude of the primary patterns on a predefined envelope or enclosure surrounding and/or enclosing the acoustic control zone and/or at one or more predefined locations within the acoustic control zone.

In one example, the acoustic control zone may include a two-dimensional zone, e.g., defining an area in which the acoustic energy and/or wave amplitude of one or more of the primary patterns is to be controlled, reduced and/or eliminated.

According to this example, the AAC system may be configured to control, reduce and/or eliminate the acoustic energy and/or wave amplitude of the primary patterns along a perimeter surrounding the acoustic control zone and/or at one or more predefined locations within the acoustic control zone.

In one example, the acoustic control zone may include a three-dimensional zone, e.g., defining a volume in which the acoustic energy and/or wave amplitude of one or more of the primary patterns is to be controlled, reduced and/or eliminated. According to this example, the AAC system may be configured to control, reduce and/or eliminate the acoustic energy and/or wave amplitude of the primary patterns on a surface enclosing the three-dimensional volume.

In one example, the acoustic control zone may include a spherical volume and the AAC system may be configured to control, reduce and/or eliminate the acoustic energy and/or wave amplitude of the primary patterns on a surface of the spherical volume.

In another example, the acoustic control zone may include a cubical volume and the AAC system may be configured to control, reduce and/or eliminate the acoustic energy and/or wave amplitude of the primary patterns on a surface of the cubical volume.

In other embodiments, the acoustic control zone may include any other suitable volume, which may be defined, for example, based on one or more attributes of a location at which the acoustic control zone is to be maintained.

Figure 7:
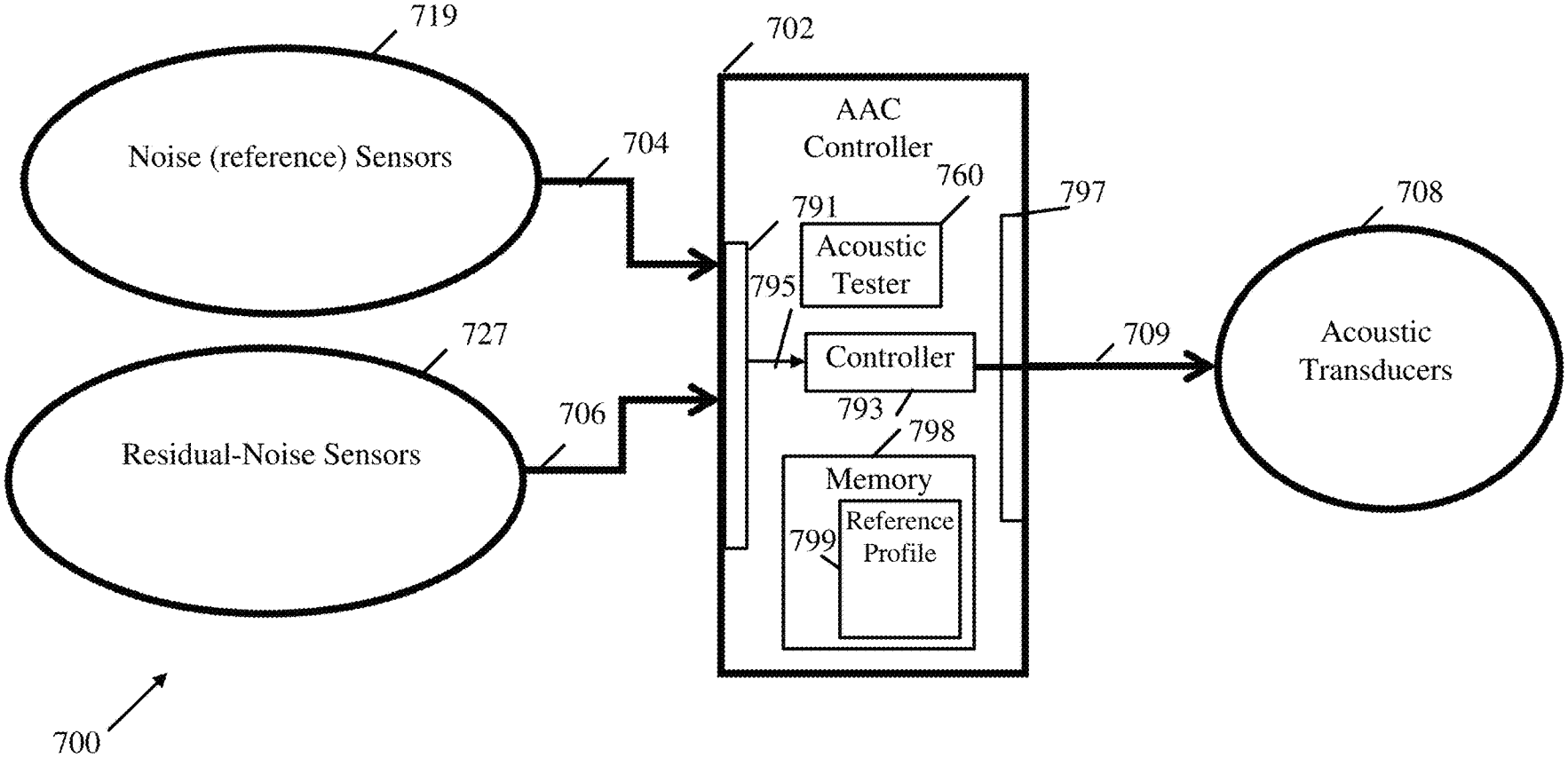
FIG. 7 is a schematic illustration of an Active Acoustic Control (AAC) system, in accordance with some demonstrative embodiments.

Reference is made to FIG. 7, which schematically illustrates an AAC system 700, in accordance with some demonstrative embodiments.

Figure 8:
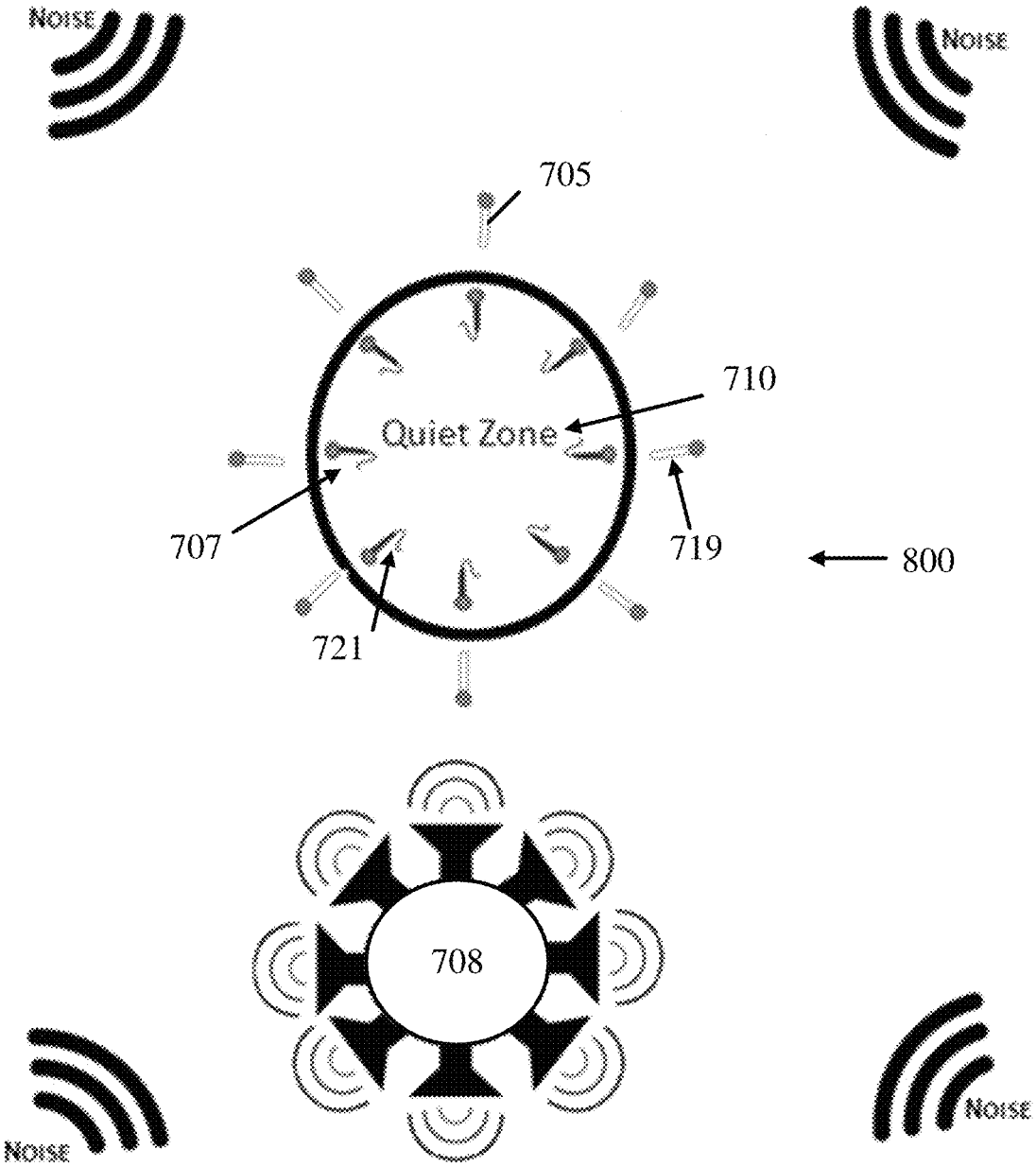
FIG. 8 is a schematic illustration of a deployment scheme of components of an AAC system, in accordance with some demonstrative embodiments.

Reference is also made to FIG. 8, which schematically illustrates a deployment scheme 800 of components of an AAC system, in accordance with some demonstrative embodiments. For example, deployment scheme 800 may include a deployment of one or more elements of the AAC system 100 of FIG. 1. In one example, device 102 (FIG. 1) may be configured to perform one or more operations and/or functionalities of AAC system 700, and/or the one or more acoustic devices 150 (FIG. 1) may include one or more acoustic sensors and/or acoustic transducers of the NAC system 700.

In some demonstrative embodiments, AAC system 700 may include, operate as, and/or perform functionalities of, an Active Noise Cancelation system.

In some demonstrative embodiments, AAC system 700 may include a controller 702 to control sound within at least one sound-control zone 710, e.g., as described in detail below.

In some demonstrative embodiments, controller 702 may include, or may be implemented, partially or entirely, by circuitry and/or logic, e.g., one or more processors including circuitry and/or logic, and/or memory circuitry and/or logic. Additionally or alternatively, one or more functionalities of radar controller 702 may be implemented by logic, which may be executed by a machine and/or one or more processors, e.g., as described below.

In one example, controller 702 may include at least one memory, e.g., coupled to the one or more processors, which may be configured, for example, to store, e.g., at least temporarily, at least some of the information processed by the one or more processors and/or circuitry, and/or which may be configured to store logic to be utilized by the processors and/or circuitry.

In one example, at least part of the functionality of controller 702 may be implemented by an integrated circuit, for example, a chip, e.g., a System on Chip (SoC).

In other embodiments, controller 702 may be implemented by any other logic and/or circuitry, and/or according to any other architecture.

In some demonstrative embodiments, sound control zone 710 may include a three-dimensional (3D) zone. For example, sound control zone 710 may include a spherical zone.

In another example, sound control zone 710 may include any other 3D zone.

In some demonstrative embodiments, AAC controller 702 may include, or may be implemented with, an input 791, which may be configured to receive input information 795, e.g., as described below.

In some demonstrative embodiments, the input information 795 may include a plurality of noise inputs 704, e.g., from one or more acoustic sensors (also referred to as "primary sensors", "noise sensors" or "reference sensors") 719, representing acoustic noise at a plurality of predefined noise sensing locations 705, e.g., as described below.

In some demonstrative embodiments, AAC controller 702 may receive noise inputs 704 from one or more acoustic sensors 719, which may include one or more physical sensors, e.g., microphones, accelerometers, tachometers and the like, located at one or more of locations 705 configured to estimate the acoustic noise at one or more of locations 705, e.g., as described below.

In some demonstrative embodiments, the input information 795 may include a plurality of residual-noise inputs 706, e.g., from one or more residual-noise acoustic sensors (also referred to as "error sensors", or "secondary sensors") 721, representing acoustic residual-noise at a plurality of predefined residual-noise sensing locations 707, which are located within sound-control zone 710, e.g., as described below.

In some demonstrative embodiments, AAC controller 702 may receive residual-noise inputs 706 from one or more acoustic sensors 721, which may include one or more physical sensors, e.g., microphones, accelerometers tachometers and the like, located at one or more of locations 707, e.g., as described below.

In some demonstrative embodiments, AAC system 700 may include at least one acoustic transducer 708, e.g., a speaker, a shaker, and/or any other actuator. For example, AAC controller 702 may control acoustic transducer 708 to generate an acoustic sound control pattern configured to control the sound within sound control zone 710, e.g., as described in detail below.

In some demonstrative embodiments, AAC controller 702 may include a controller 793 configured to determine the sound control pattern to control sound within the at least one sound control zone 710 in the vehicle, e.g., as described below.

In some demonstrative embodiments, controller 793 may be configured to determine the sound control pattern based on the plurality of noise inputs 704 and the plurality of residual-noise inputs, e.g., as described below.

In some demonstrative embodiments, AAC controller 702 may include an output 797 to output the sound control pattern to a plurality of acoustic transducers. For example, output 797 may be configured to output the sound control pattern in the form of a sound control signal 709 to control acoustic transducer 708, e.g., as described below.

In some demonstrative embodiments, the predefined sound-control zone 710 may include an enclosed space, e.g., as described below.

In some demonstrative embodiments, the enclosed space may include a cabin of a vehicle, for example, a car, a bus, and/or a truck, e.g., as described below.

In some demonstrative embodiments, the enclosed space may include any other cabin, e.g., a cabin of an airplane, a cabin of a train, a cabin of a medical system, an area of a room, and the like.

In other embodiments, the enclosed space may include any other enclosed part or area of a space.

In some demonstrative embodiments, sound-control zone 710 may be located inside a vehicle, and AAC system 700 may be deployed inside of the vehicle.

In one example, the acoustic sensors 719, the error sensors 721, and/or the acoustic transducers 708 may be located and/or assembled in a cabin of the vehicle.

In some demonstrative embodiments, AAC system 700 may be configured to control sound and/or noise within zone 710, for example, to provide an improved driving experience for driver and/or one or more passengers of the vehicle, for example, by controlling sound and/or noise within zone 710 in a way which provide an improved music and/or sound experience within the vehicle, an improved quality of phone conversations, and/or the like.

In some demonstrative embodiments, AAC system 700 may include an acoustic device tester 760, for example, configured to test and/or diagnose acoustic devices of the AAC system 700, e.g., as described below. For example, acoustic device tester 760 may include acoustic device tester 160 (FIG. 1), and/or may perform one or more operations and/or functionalities of acoustic device tester 160 (FIG. 1).

In one example, acoustic device tester 760 may be configured to test and/or diagnose the acoustic sensors 719, the error sensors 721, and/or the acoustic transducers 708 of AAC system 700.

In one example, acoustic device tester 760 may be implemented as part of AAC controller 702.

In another example, acoustic device tester 760 and AAC controller 702 may be implemented as separate elements of AAC system 700.

In another example, acoustic device tester 760 may be implemented remotely, e.g., as part of server 170 (FIG. 1). According to this example, a front end of acoustic device tester 760 and/or AAC controller 702 may be configured to send acoustic transfer functions of the acoustic sensors 719, the error sensors 721, and/or the acoustic transducers 708 to server 170 (FIG. 1) and/or to a back-end of acoustic device tester 760; and server 170 (FIG. 1) and/or the back-end of acoustic device tester 760 may be configured to test and/or diagnose the acoustic sensors 719, the error sensors 721, and/or the acoustic transducers 708.

In some demonstrative embodiments, acoustic device tester 760 may be configured to test and/or diagnose the acoustic sensors 719, the error sensors 721, and/or the acoustic transducers 708, for example, based on a plurality of reference profiles 799, e.g., as described below.

In some demonstrative embodiments, AAC controller 702 may include a memory 798 to store the plurality of reference profiles 799. For example, a reference profile 799 may include a reference acoustic value distribution, e.g., in the form of a reference STF, and threshold information corresponding to a combination of an acoustic sensor and an acoustic transducer, e.g., as described below.

In some demonstrative embodiments, acoustic device tester 760 may be configured to test and/or diagnose the acoustic devices of AAC system 700, e.g., one or more of the acoustic sensors 719, the error sensors 721, and/or the acoustic transducers 708, for example, at a manufacturing EOL of the vehicle.

In some demonstrative embodiments, acoustic device tester 760 may be configured to test and/or diagnose the acoustic devices of AAC system 700, e.g., the acoustic sensors 719, the error sensors 721, and/or the acoustic transducers 708, post production, for example, after sale of the vehicle to a client.

demonstrative embodiments, acoustic device tester 760 may be configured to test and/or diagnose the acoustic devices of AAC system 700, e.g., the acoustic sensors 719, the error sensors 721, and/or the acoustic transducers 708, for example, during maintenance of the vehicle and/or of the AAC system 700.

demonstrative embodiments, acoustic device tester 760 may be configured to test and/or diagnose the acoustic devices of AAC system 700, e.g., the acoustic sensors 719, the error sensors 721, and/or the acoustic transducers 708, for example, in real time, e.g., during operation of the AAC system 700.

Figure 9:
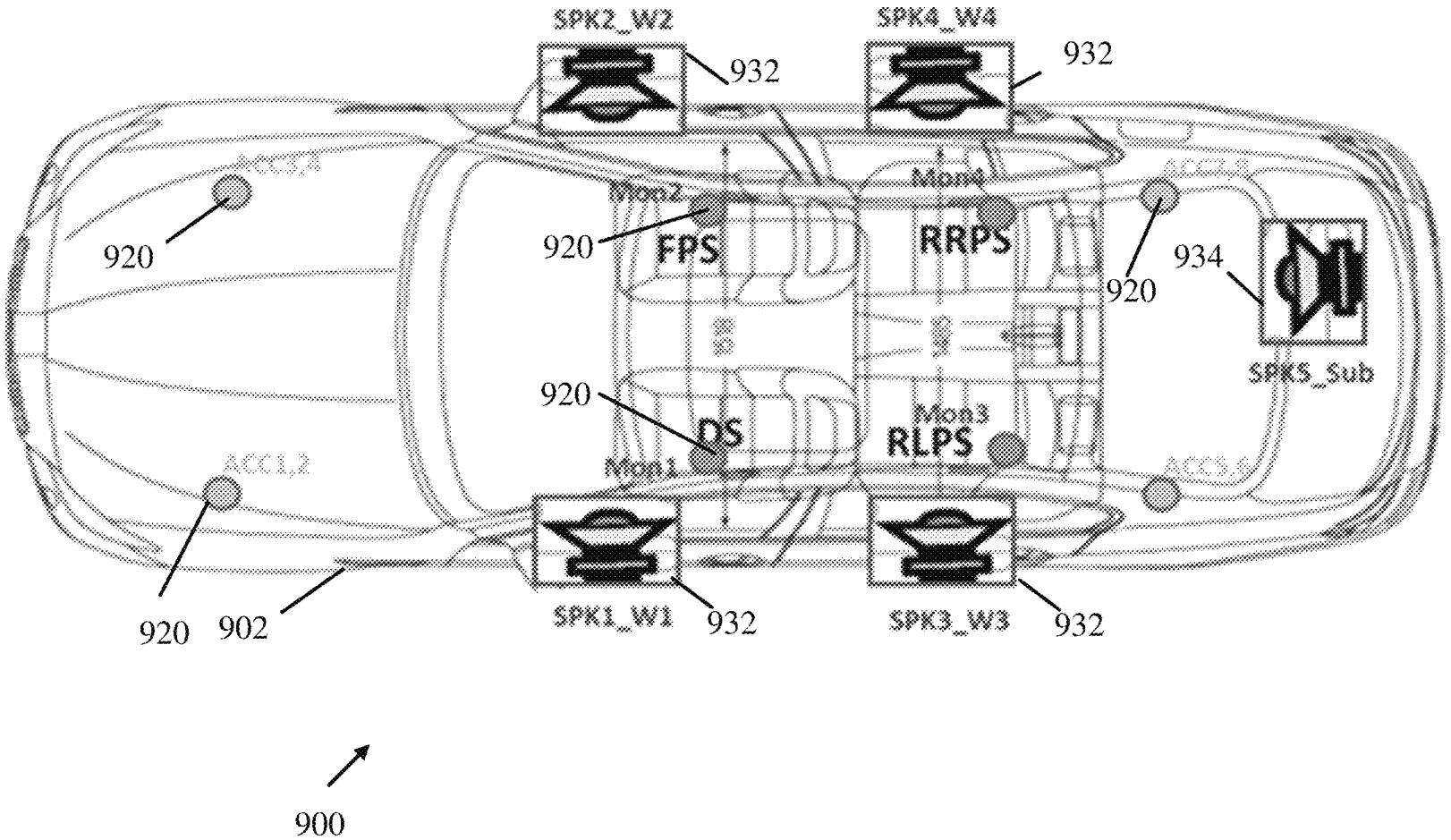
FIG. 9 is a schematic illustration of a deployment of an AAC system in a vehicle, in accordance with some demonstrative embodiments.

Reference is made to FIG. 9, which schematically illustrates a deployment of AAC system 900 in a vehicle 902, in accordance with some demonstrative embodiments.

In some demonstrative embodiments, as shown in FIG. 9, AAC system 900 may include a plurality of acoustic sensor devices 920, e.g., motioning microphones.

In some demonstrative embodiments, as shown in FIG. 9, AAC system 900 may include a plurality of acoustic transducer devices, e.g., a plurality of door speakers 932 and a subwoofer speaker 934.

In some demonstrative embodiments, acoustic device tester 760 (FIG. 7) may be configured to test and/or diagnose the acoustic devices of AAC system 900, e.g., acoustic sensor devices 920, the plurality of door speakers 932 and/or the subwoofer speaker 934, for example, at an EOL of manufacturing vehicle 902, and/or post manufacturing, for example, during maintenance of the vehicle 902 and/or during real-time operation of the AAC system 900.

Figure 10:
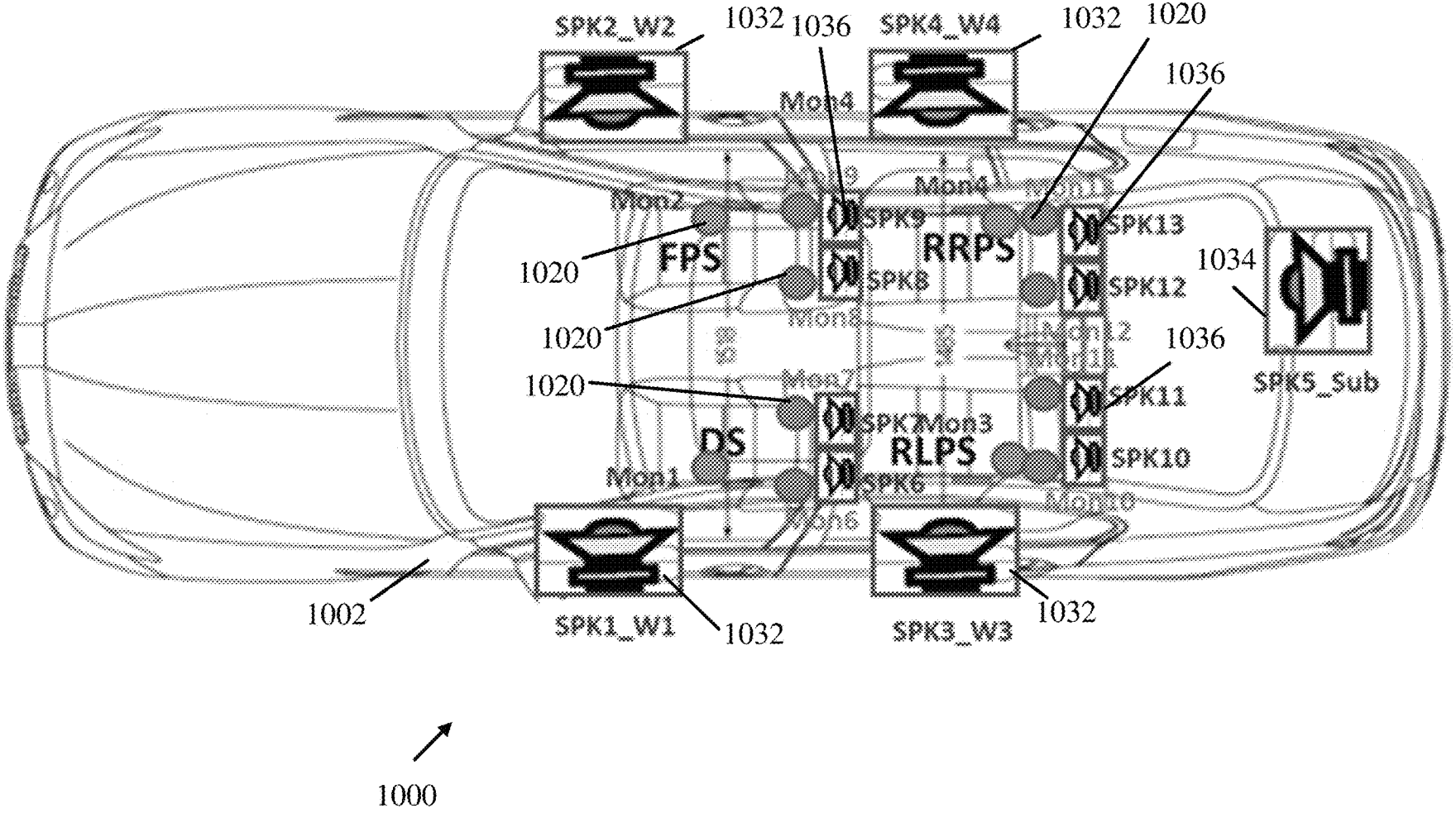
FIG. 10 is a schematic illustration of a deployment of an AAC system in a vehicle, in accordance with some demonstrative embodiments.

Reference is made to FIG. 10, which schematically illustrates a deployment of an AAC system 1000 in a vehicle 1002, in accordance with some demonstrative embodiments.

In some demonstrative embodiments, as shown in FIG. 10, AAC system 1000 may include a plurality of acoustic sensor devices 1020, e.g., motioning microphones.

In some demonstrative embodiments, as shown in FIG. 10, AAC system 1000 may include a plurality of acoustic transducer devices, e.g., a plurality of door speakers 1032, a plurality of headrest speakers 1036, and a subwoofer speaker 1034.

In some demonstrative embodiments, acoustic device tester 760 (FIG. 7) may be configured to test and/or diagnose the acoustic devices of AAC system 1000, e.g., the acoustic sensor devices 1020, the plurality of door speakers 1032, the plurality of headrest speakers 1036 and/or the subwoofer speaker 1034, for example, at an EOL of manufacturing vehicle 1002, and/or post manufacturing, for example, during maintenance of the vehicle 1002 and/or during real-time operation of the AAC system 1000.

Referring back to FIG. 7, in some demonstrative embodiments, acoustic device tester 760 may be configured to test and/or diagnose the acoustic sensors 719, the error sensors 721, and/or the acoustic transducers 708, for example, when deployed in a vehicle, e.g., vehicle 902 (FIG. 9) and/or vehicle 1002 (FIG. 10), and/or in any other product or system utilizing AAC, e.g., as described below.

In some demonstrative embodiments, acoustic device tester 760 may perform one or more operations, for example, to test and/or diagnose the acoustic devices of the AAC system 700, for example, to ensure that the AAC system 700 is meeting a defined performance spec.

In one example, acoustic device tester 760 may perform one or more operations to validate that some or even all components of AAC system 700 are within a defined manufacture tolerance spec, e.g., for each product assembly integrated with the AAC system 700.

In some demonstrative embodiments, acoustic device tester 760 may perform one or more operations, for example, to test and/or diagnose the acoustic devices of the AAC system 700, for example, to validate that assembly of AAC system 700 within the vehicle, e.g., vehicle 902 (FIG. 9) and/or vehicle 1002 (FIG. 10), is completed without any faulty/damaged components and/or faulty component mounting.

In some demonstrative embodiments, acoustic device tester 760 may be configured to determine one or more reference profiles, for example, including a reference acoustic value distribution, e.g., a reference transfer function, and threshold information, for example, corresponding to the acoustic devices of the AAC system 700, e.g., as described below.

In some demonstrative embodiments, acoustic device tester 760 may be configured to determine the reference profiles, for example, with respect to one or more preconfigured settings of the AAC system 700 and/or the vehicle.

In some demonstrative embodiments, acoustic device tester 760 may test and/or diagnose the acoustic devices of the AAC system 700 in the vehicle, for example, once a preconfigured setting is fulfilled.

In one example, the preconfigured settings may include vehicle settings, vehicle conditions, vehicle status, and/or any other settings, e.g., one or more of the following setting:

Vehicle seat positions status
Vehicle seat number of occupant's
Door/Window/Roof/Sunroof Status
Ignition Status
Engine Status
Vehicle RPM status
Vehicle speed status
Heating, Ventilation And Air Conditioning (HVAC) status/speed
Radio status
Temperature status In/out cabin.
System configuration: position and number of speakers and sensors, gains, etc.

In other embodiments, acoustic device tester 760 may determine the reference profiles with respect to any other additional or alternative preconfigured settings.

In some demonstrative embodiments, acoustic device tester 760 may determine a reference AVD and/or MTF for a plurality of acoustic sensors of AAC system 700, e.g., the acoustic sensors 719, and/or the error sensors 721.

In some demonstrative embodiments, acoustic device tester 760 may determine one or more reference STFs for a plurality of acoustic transducers devices of AAC system 700, e.g., the transducers 708, for example, with respect to the error sensors 721.

In some demonstrative embodiments, acoustic device tester 760 may utilize different reference STF profiles, for example, for different types and/or configurations of acoustic transducer devices. For example, acoustic device tester 760 may utilize a first reference STF profile for a headrest speaker, a second reference STF profile for a door speaker, and/or a third reference STF profile for a subwoofer speaker.

In some demonstrative embodiments, acoustic device tester 760 may store the reference AVD and/or MTF and/or the reference STF, for example, in memory 798.

In some demonstrative embodiments, acoustic device tester 760 may determine a tested STF vector for one or more, e.g., for each, of the acoustic sensor devices.

In some demonstrative embodiments, acoustic device tester 760 may determine a tested AVD and/or MTF vector for one or more, e.g., for each, of the acoustic transducer devices.

In one example, acoustic device tester 760 may test and/or diagnose the acoustic sensor devices of the AAC system in the vehicle, for example, based on the tested AVD and/or MTF vectors, e.g., as follows:

Test each input (microphones and/or accelerometers) signal at ⅓ octave spectra within −/+X_TH(dB) variance to match the reference AVD and/or MTF, which may be divided to two or more frequency bands at the cutoff frequency (F):
Low_TH(<F[Hz]) dB
High_TH(>F[Hz]) dB In some demonstrative embodiments, acoustic device tester 760 may determine a plurality of tested STF vectors for the acoustic sensor devices.

In some demonstrative embodiments, acoustic device tester 760 may test and/or diagnose the acoustic transducer devices of the AAC system 700 in the vehicle, for example, based on the plurality of tested STF vectors, e.g., as follows:

Determine Speakers/actuators Transfer Function (STF)
Test each STF data ⅓ octave TF is within −/+X_THdB variance of STF reference profile in a defined BW [MinFreq:MaxFreq] define by the speaker type, e.g., one or more of:
Headrest Speaker (SPK)
Door SPK
Subwoofer SPK; and/or
Any other speaker type Determine Diagnostics results Fail/Pass bitmap table output, e.g., in a form of matrix 600 (FIG. 6), with individual reference sensor, monitoring sensor and/or speaker failure/pass indication, e.g., as described above.

In some demonstrative embodiments, acoustic device tester 760 may determine failure of a tested acoustic transfer function, for example, based on one or more failure criteria.

In some demonstrative embodiments, the failure criteria may be based on the reference profiles for the speakers 708, reference microphones 719, and/or monitoring microphones 721.

In one example, the failure criteria may be predefined, for example, per vehicle, and/or per AAC system.

In some demonstrative embodiments, the failure criteria may be set to validate speakers and reference/monitoring sensors, e.g., microphones, for example, to meet a sensitivity spec and/or a response curve within ±X dB variance, e.g., as defined by the threshold information.

Figure 11:
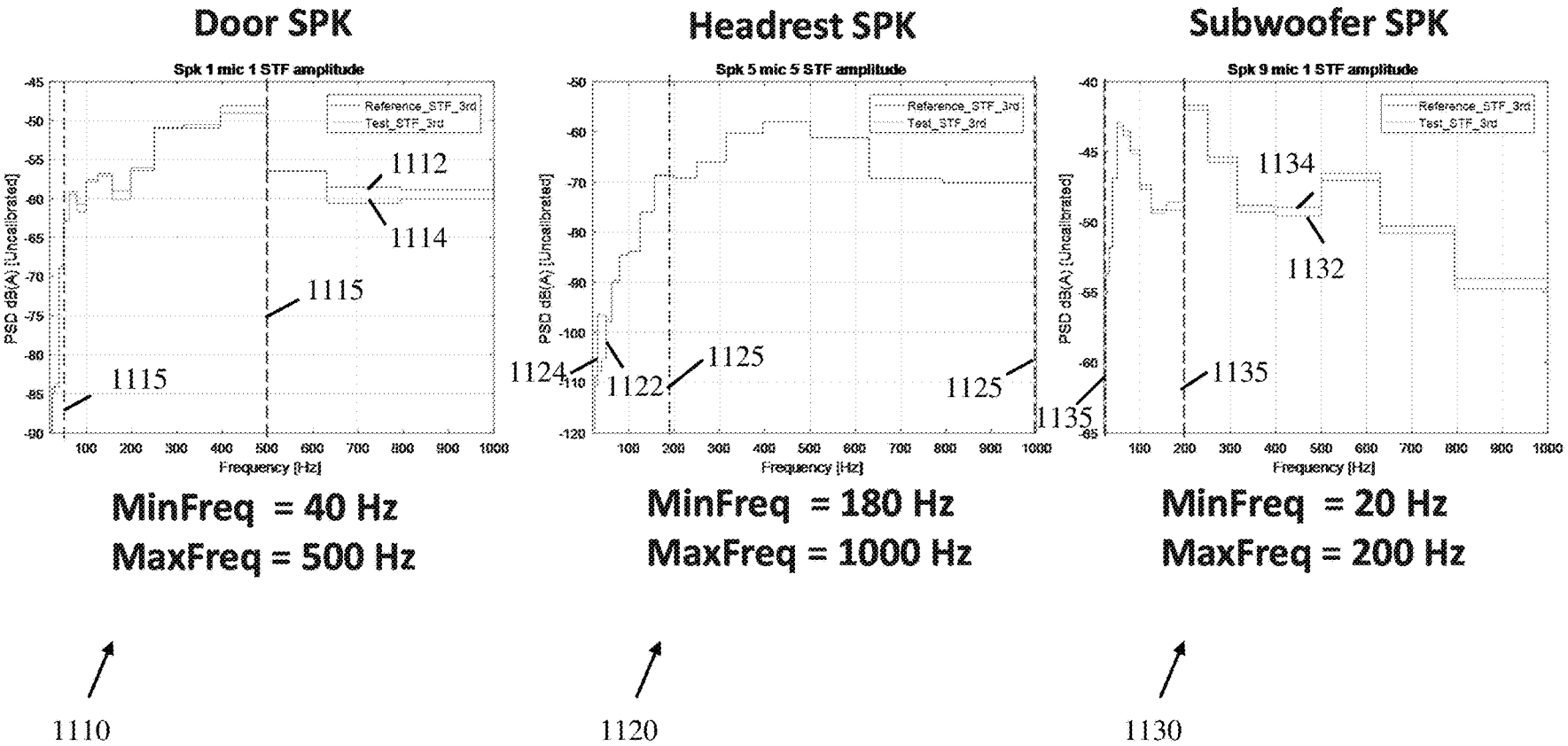
FIG. 11 is a schematic illustration of a plurality of graphs depicting a plurality of respective reference Speaker Transfer Functions (STFs) corresponding to a respective plurality of speaker deployments, in accordance with some demonstrative embodiments.

Reference is made to FIG. 11, which schematically illustrates a plurality of graphs depicting a plurality of respective reference STFs corresponding to a respective plurality of speaker deployments, in accordance with some demonstrative embodiments.

In some demonstrative embodiments, as shown in FIG. 11, a graph 1110 depicts a tested STF 1112 of a door speaker compared to a reference STF 1114 of the door speaker. For example, graph 1110 may represent the tested STF and the reference STF of door speaker 932 (FIG. 9), and/or door speaker 1032 (FIG. 10).

In some demonstrative embodiments, as shown in FIG. 11, graph 1110 depicts two cut-off frequencies 1115, between which a predefined, e.g., low, threshold may be used, e.g., to compare between energies of the tested STF 1112 and energies of the reference STF 1114.

In some demonstrative embodiments, as shown in FIG. 11, a graph 1120 depicts a tested STF 1122 of a headrest speaker compared to a reference STF 1124 of the headrest speaker. For example, graph 1120 may represent the tested STF and the reference STF of headrest speaker 1036 (FIG. 10).

In some demonstrative embodiments, as shown in FIG. 11, graph 1120 depicts two cut-off frequencies 1125, between which a predefined, e.g., low, threshold may be used, e.g., to compare between energies of STF 1122 and energies of the reference STF 1124.

In some demonstrative embodiments, as shown in FIG. 11, a graph 1130 depicts a tested STF 1132 of a subwoofer speaker compared to a reference STF 1134 of the subwoofer speaker. For example, graph 1130 may represent the tested STF and the reference STF of subwoofer speaker 934 (FIG. 9), and/or door speaker 1034 (FIG. 10).

In some demonstrative embodiments, as shown in FIG. 11, graph 1130 depicts two frequencies 1135, between which a predefined, e.g., low, threshold may be used, e.g., to compare between energies of the STF 1132 and energies of the reference STF 1134.

Figure 12:
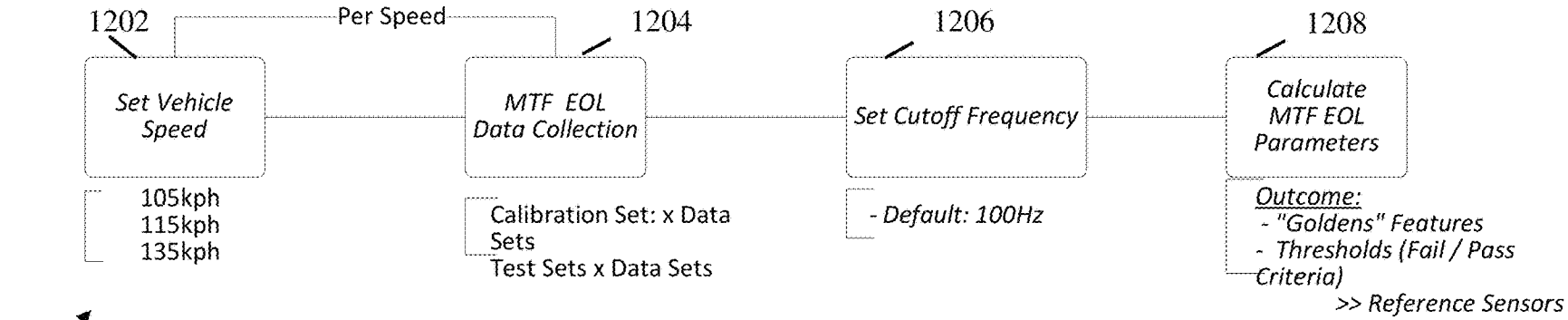
FIG. 12 is a schematic illustration of a flow chart of a method of determining a reference profile for one or more acoustic sensor devices, in accordance with some demonstrative embodiments.

Reference is made to FIG. 12, which schematically illustrates a flow chart of a method 1200 of determining a reference profile for one or more acoustic sensor devices, in accordance with some demonstrative embodiments.

In one example, the method 1200 may be configured to determine a reference profile for an acoustic sensor device of an AAC system in a vehicle, for example, to be used as part of an MTF EOL test, and/or any other test. For example, one or more operations of the method 1200 may be implemented by acoustic device tester 760 (FIG. 7) to determine a reference profile for a microphone 920 (FIG. 9) of AAC system 900 (FIG. 9) in vehicle 902 (FIG. 9), and/or a reference profile for a microphone 1020 (FIG. 10) of AAC system 1000 (FIG. 10) in vehicle 1002 (FIG. 10).

In some demonstrative embodiments, as indicated at block 1202, the method may include setting a vehicle speed of the vehicle. For example, acoustic device tester 760 (FIG. 7) may be configured to control, cause, trigger and/or instruct, a user of AAC system 900 (FIG. 9) and/or AAC system 1000 (FIG. 10), and/or a controller of vehicle 902 (FIG. 9) and/or vehicle 1002 (FIG. 10) to set the vehicle speed, for example, according to a predefined speed, e.g., 105 kilometers per hour (kph), 125 kph, 135 kph, and/or any other speed.

In some demonstrative embodiments, as indicated at block 1204, the method may include determining a plurality of measurements corresponding to the plurality of vehicle speeds. For example, acoustic device tester 760 (FIG. 7) may be configured to determine the plurality of measurements for the acoustic sensor device, for example, based on a calibration set, e.g., including 10 data sets, and a test set, e.g., including 10 test sets, and/or any other number of data sets and/or test sets.

In some demonstrative embodiments, as indicated at block 1206, the method may include determining a cut-off frequency to be applied for the reference profile. For example, acoustic device tester 760 (FIG. 7) may determine a cut-off frequency, for example, 100 Hz or any other frequency to define thresholds to be applied to two or more frequency sub-bands, e.g., as described above.

In some demonstrative embodiments, as indicated at block 1208, the method may include determining a reference profile, e.g., an "MTF EOL profile", including reference values and threshold information for testing the acoustic sensor device. For example, acoustic device tester 760 (FIG. 7) may determine the reference profile including the reference values, thresholds, and/or the failure criteria, e.g., as described above.

Figure 13:
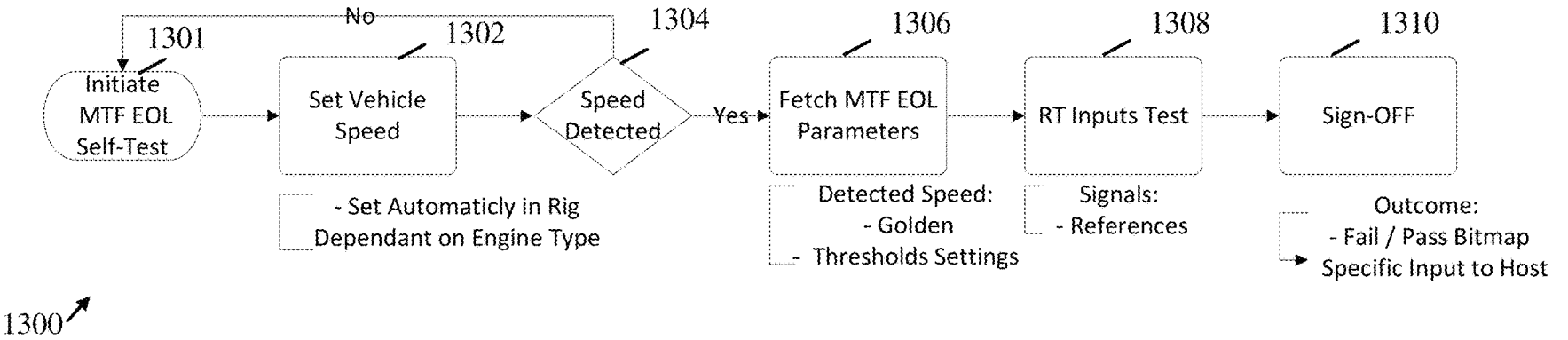
FIG. 13 is a schematic illustration of a flow chart of a method of testing one or more acoustic sensor devices, in accordance with some demonstrative embodiments.

Reference is made to FIG. 13, which schematically illustrates a flow chart of a method 1300 of testing one or more acoustic sensor devices, in accordance with some demonstrative embodiments.

In one example, the method 1300 may be configured to determine whether or not one or more acoustic sensor devices of an AAC system in a vehicle are faulty. For example, one or more operations of the method 1300 may be implemented by acoustic device tester 760 (FIG. 7) to determine whether or not a microphone 920 (FIG. 9) of AAC system 900 (FIG. 9) in vehicle 902 (FIG. 9), and/or a microphone 1020 (FIG. 10) of AAC system 1000 (FIG. 10) in vehicle 1002 (FIG. 10) is faulty.

In some demonstrative embodiments, as indicated at block 1301, the method may include initiating, e.g., by a test controller, an acoustic testing procedure, e.g., for testing the acoustic sensor devices. In one example, the acoustic testing procedure may be initiated as part of an MTF EOL self-test procedure. In other embodiments, the acoustic testing procedure may be initiated and/or performed as a separate procedure or as part of any other procedure.

In some demonstrative embodiments, as indicated at block 1302, the method may include setting a vehicle speed of the vehicle, for example, according to a predefined speed. For example, acoustic device tester 760 (FIG. 7) may be configured to control, cause, trigger and/or instruct, a user of AAC system 900 (FIG. 9) and/or AAC system 1000 (FIG. 10), and/or a controller of vehicle 902 (FIG. 9) and/or vehicle 1002 (FIG. 10) to set the vehicle speed, for example, according to the predefined speed, e.g., of 105 kph, 135 kph, 135 kph, and/or any other speed.

In one example, the user may set the speed in a testing rig, e.g., a mechanical testing rig.

In another example, the speed may depend on type of the vehicle and/or an engine of the vehicle.

In some demonstrative embodiments, as indicated at block 1304, the method may include checking if the vehicle speed is at the predefined speed. For example, acoustic device tester 760 (FIG. 7) may be configured to control, cause, trigger and/or instruct, a user of AAC system 900 (FIG. 9) and/or AAC system 1000 (FIG. 10), and/or a controller of vehicle 902 (FIG. 9) and/or vehicle 1002 (FIG. 10) to check the vehicle speed, for example, according to the predefined speed.

In some demonstrative embodiments, as indicated at block 1306, the method may include retrieving a reference profile, e.g., the MTF EOL profile, including the reference values and threshold information corresponding to the acoustic sensor device. For example, acoustic device tester 760 (FIG. 7) may retrieve, e.g., from memory 798 (FIG. 7), the reference profile 799 (FIG. 7), including the reference values, a cut off frequency, and/or a failure criteria corresponding to the tested speed, e.g., as described above.

In some demonstrative embodiments, as indicated at block 1308, the method may include determining a tested acoustic value distribution for the acoustic sensor device. For example, acoustic device tester 760 (FIG. 7) may determine the tested acoustic value distribution the acoustic sensor device, e.g., as described above.

In some demonstrative embodiments, as indicated at block 1310, the method may include determining whether or not the acoustic sensor device is faulty. For example, acoustic device tester 760 (FIG. 7) may be configured to determine whether or not the acoustic sensor device is faulty, for example, based on the tested acoustic value distribution and the reference profile, e.g., as described above. For example, acoustic device tester 760 (FIG. 7) may be configured to determine a fail/pass bitmap, for example, in the form of matrix 600 (FIG. 6), e.g., as described above.

Figure 14:
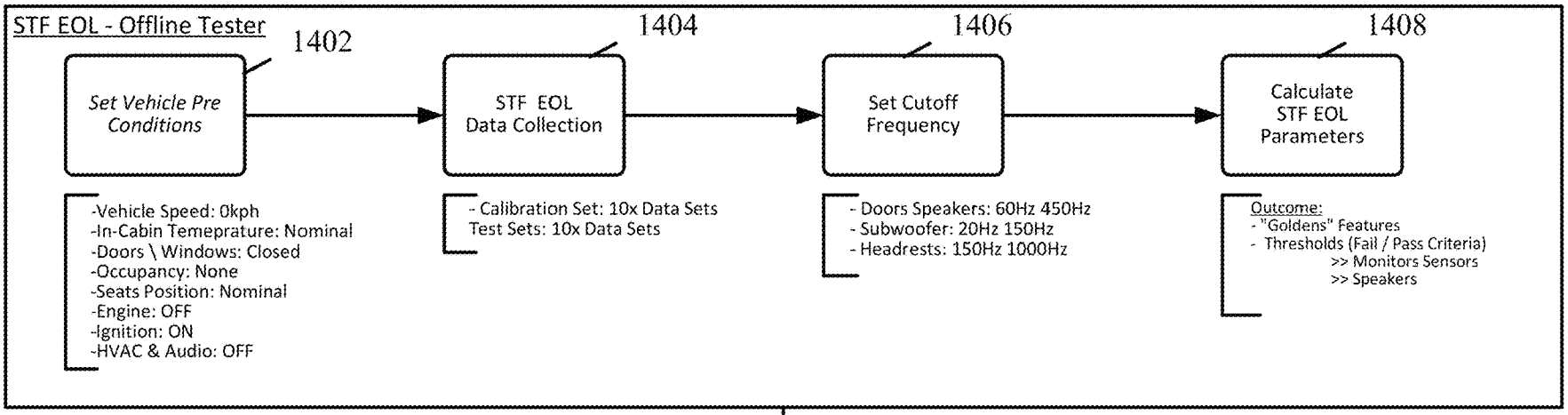
FIG. 14 is a schematic illustration of a flow chart of a method of determining a reference profile for one or more acoustic transducer devices, in accordance with some demonstrative embodiments.

Reference is made to FIG. 14, which schematically illustrates a flow chart of a method 1400 of determining a reference profile for one or more acoustic transducer devices, in accordance with some demonstrative embodiments.

In one example, the method 1400 may be configured to determine a reference profile for one or more acoustic transducer devices of an AAC system in a vehicle, for example, to be used as part of an STF EOL test, and/or any other test. For example, one or more operations of the method 1400 may be implemented by acoustic device tester 760 (FIG. 7) to determine one or more reference profiles for the acoustic transducer devices of AAC system 900 (FIG. 9) in vehicle 902 (FIG. 9), e.g., the plurality of door speakers 932 (FIG. 9) and/or the subwoofer speaker 934 (FIG. 9), and/or one or more reference profiles for the acoustic transducer devices of AAC system 1000 (FIG. 10) in vehicle 1002 (FIG. 10), e.g., the plurality of door speakers 1032 (FIG. 10), the plurality of headrest speakers 1036 (FIG. 10), and/or the subwoofer speaker 1034 (FIG. 10).

In some demonstrative embodiments, as indicated at block 1402, the method may include setting one or more vehicle preconditions to be applied for the reference profile. For example, acoustic device tester 760 (FIG. 7) may be configured to control, cause, trigger and/or instruct, a user of AAC systems 900 (FIG. 9) and/or 1000 (FIG. 10), and/or a controller of vehicle 902 (FIG. 9) and/or vehicle 1002 (FIG. 10) to set the vehicle preconditions.

In some demonstrative embodiments, the one or more vehicle preconditions may include vehicle settings, vehicle conditions, vehicle status, and/or any other settings, which may be applicable for the reference profile.

For example, the one or more vehicle preconditions may include one or more of the following settings:

- Vehicle seat positions status
- Vehicle seat number of occupant's
- Door/Window/Roof/Sunroof Status
- Ignition Status
- Engine Status
- Vehicle RPM status
- Vehicle speed status
- Heating, Ventilation And Air Conditioning (HVAC) status/speed
- Radio status
- Temperature status In/out cabin.
- System configuration: position and number of speakers and sensors, gains, etc.

In one example, as shown in FIG. 14, some or all of the following vehicle preconditions may be set:

- Vehicle seat positions status: Nominal
- Vehicle seat number of occupant's: None
- Door/Window/Roof/Sunroof Status: Closed
- Ignition Status: On
- Engine Status: Off
- Vehicle speed status: 0 kph
- Heating, Ventilation And Air Conditioning (HVAC) status/speed: Off
- Radio status: Off
- Temperature status In/out cabin: Nominal In other embodiments, the one or more vehicle preconditions may include any other additional or alternative preconfigured settings.

In some demonstrative embodiments, as indicated at block 1404, the method may include determining a plurality of measurements corresponding to the vehicle precondition setting. For example, acoustic device tester 760 (FIG. 7) may be configured to determine the measurements for the vehicle precondition setting, for example, based on a calibration set, e.g., including 10 data sets, and a test set, e.g., including 10 test sets, and/or any other number of data sets and/or test sets.

In some demonstrative embodiments, as indicated at block 1406, the method may include determining one or more cut-off frequencies to be applied for the reference profile. For example, acoustic device tester 760 (FIG. 7) may determine one or more cut off frequencies corresponding to different types of the acoustic transducer devices, e.g., as described above.

In one example, as shown in FIG. 14, a first cut-off frequency, e.g., a "low" cut-off frequency of 60 Hz, and a second cut-off, e.g., a "high" cut-off frequency of 450 Hz, may be defined for one or more speakers of a first type, e.g., speakers ("door speakers") in doors of the vehicle.

In one example, as shown in FIG. 14, a first cut-off frequency, e.g., a "low" cut-off frequency of 20 Hz, and a second cut-off, e.g., a "high" cut-off frequency of 150 Hz, may be defined for one or more speakers of a second type, e.g., a subwoofer, the vehicle.

In one example, as shown in FIG. 14, a first cut-off frequency, e.g., a "low" cut-off frequency of 150 Hz, and a second cut-off, e.g., a "high" cut-off frequency of 1000 Hz, may be defined for one or more speakers of a third type, e.g., speakers ("headrest speakers") in headrests of the vehicle.

In some demonstrative embodiments, as indicated at block 1408, the method may include determining a reference profile, e.g., an "STF EOL profile", including reference values and threshold information for testing the one or more acoustic transducer devices. For example, acoustic device tester 760 (FIG. 7) may determine the reference profile including the reference values, the cut-off frequencies, thresholds, and/or the failure criteria, e.g., as described above.

Figure 15:
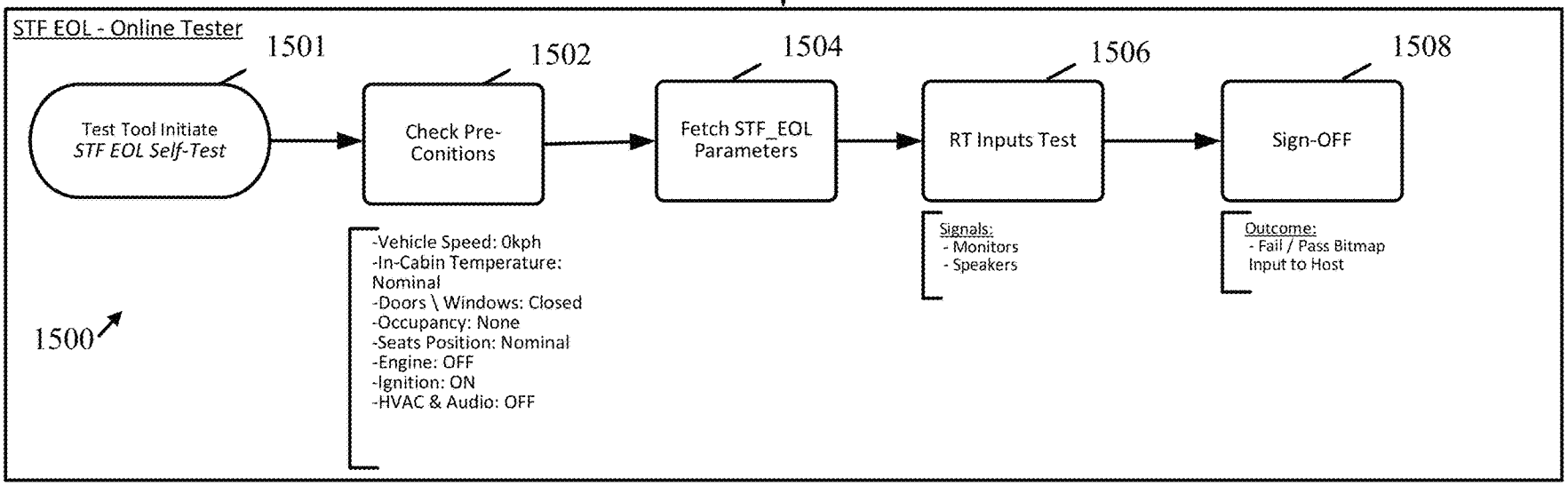
FIG. 15 is a schematic illustration of a flow chart of a method of testing one or more acoustic transducer devices, in accordance with some demonstrative embodiments.

Reference is made to FIG. 15, which schematically illustrates a flow chart of a method 1500 of testing one or more acoustic transducer devices, in accordance with some demonstrative embodiments.

In one example, the method 1500 may be configured to test whether or not one or more acoustic transducer devices of an AAC system in a vehicle are faulty. For example, one or more operations of the method 1500 may be implemented by acoustic device tester 760 (FIG. 7) to determine whether or not a door speaker 932 (FIG. 9) and/or the subwoofer speaker 934 (FIG. 9) in AAC system 900 (FIG. 9) is faulty, and/or to determine whether or not a door speaker 1032 (FIG. 10), a headrest speaker 1036 (FIG. 10), and/or the subwoofer speaker 1034 (FIG. 10) of AAC system 1000 (FIG. 10) is faulty.

In some demonstrative embodiments, as indicated at block 1501, the method may include initiating, e.g., by a test controller, an acoustic testing procedure, e.g., for testing the acoustic transducer devices. In one example, the acoustic testing procedure may be initiated as part of an STF EOL self-test procedure. In other embodiments, the acoustic testing procedure may be initiated and/or performed as a separate procedure or as part of any other procedure.

In some demonstrative embodiments, as indicated at block 1502, the method may include checking that one more vehicle preconditions settings for the test are met. For example, acoustic device tester 760 (FIG. 7) may be configured to determine that the vehicle preconditions settings of the vehicle are met, e.g., as described above.

In one example, as shown in FIG. 15, some or all of the following vehicle preconditions may be set:

Vehicle seat positions status: Nominal
Vehicle seat number of occupant's: None
Door/Window/Roof/Sunroof Status: Closed
Ignition Status: On
Engine Status: Off
Vehicle speed status: 0 kph
Heating, Ventilation And Air Conditioning (HVAC) status/speed: Off
Radio status: Off
Temperature status In/out cabin: Nominal In other embodiments, the one or more vehicle preconditions may include any other additional or alternative preconfigured settings.

In some demonstrative embodiments, as indicated at block 1504, the method may include retrieving one or more reference profiles, e.g., the STF EOL profile, including reference values and threshold information corresponding to the acoustic transducer devices. For example, acoustic device tester 760 (FIG. 7) may retrieve, e.g., from memory 798 (FIG. 7), one or more reference profiles corresponding to the one or more tested acoustic transducer devices, e.g., as described above.

In some demonstrative embodiments, as indicated at block 1506, the method may include determining a tested acoustic value distribution for the tested acoustic transducer device. For example, acoustic device tester 760 (FIG. 7) may be configured to determine the tested acoustic value distribution for the tested acoustic transducer device, e.g., as described above.

In some demonstrative embodiments, as indicated at block 1508, the method may include determining whether or not the one or more acoustic transducer devices are faulty. For example, acoustic device tester 760 (FIG. 7) may be configured to determine whether or not an acoustic transducer device is faulty, for example, based on the tested acoustic value distribution and the reference profile, e.g., as described above. For example, acoustic device tester 760 (FIG. 7) may be configured to determine a fail/pass bitmap for the one or more tested acoustic transducer devices, for example, in the form of matrix 600 (FIG. 6), e.g., as described above.

Figure 16:
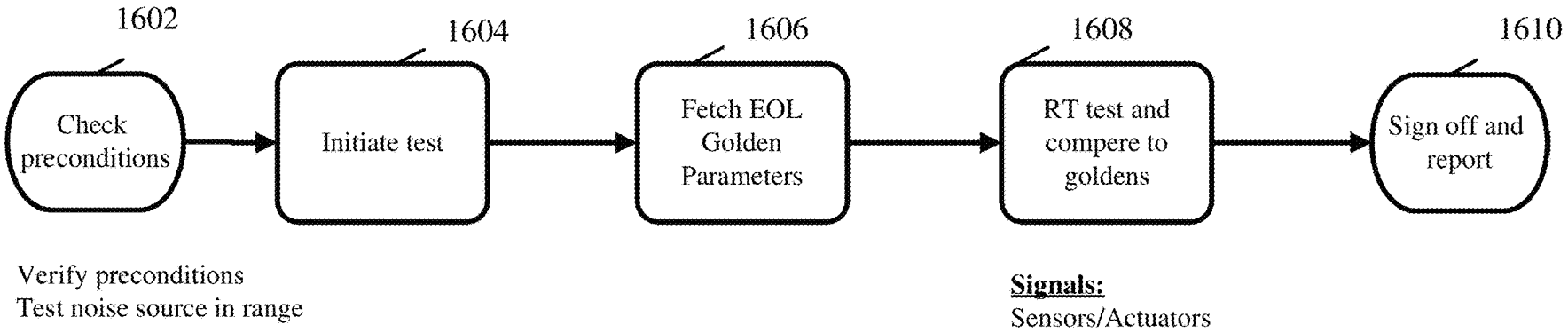
FIG. 16 is a schematic illustration of a flow chart of a method of testing an acoustic transducer device, in accordance with some demonstrative embodiments.

Reference is made to FIG. 16, which schematically illustrates a flow chart of a method of determining whether or not an acoustic device meets predefined testing criteria, in accordance with some demonstrative embodiments.

In one example, the method one or more operations of the method of FIG. 16 may be implemented to test whether or not one or more acoustic devices, e.g., acoustic device 150 (FIG. 1), are faulty and/or meet predefined testing criteria. For example, one or more operations of the method of FIG. 16 may be implemented by acoustic device tester 160 (FIG. 1) to determine whether or not one or more acoustic devices 150 (FIG. 1) are faulty and/or fail to meet a predefined specification.

In some demonstrative embodiments, as indicated at block 1602, the method may include checking that one more predefined settings for the test are met. For example, acoustic device tester 160 (FIG. 1) may be configured to determine that the preconfigured settings of the test, for example, a setup of the acoustic devices 150 (FIG. 1), a setup of one or more testing devices, a setup of a testing environment, and/or any other setting, are met, e.g., as described above.

In some demonstrative embodiments, as indicated at block 1604, the method may include initializing, e.g., by a test controller, an acoustic device testing procedure, e.g., for testing the acoustic device. For example, acoustic device tester 160 (FIG. 1) may be configured to initiate the acoustic device testing procedure.

In some demonstrative embodiments, as indicated at block 1606, the method may include retrieving one or more reference profiles, for example, including reference values for a plurality of frequency sub-bands, e.g., in the form of one or more reference acoustic transfer functions, e.g., a reference STF, a reference AVD and/or a reference MTF, and/or threshold information corresponding to the plurality of frequency sub-bands. For example, acoustic device tester 160 (FIG. 1) may retrieve, e.g., from memory 194 (FIG. 1), reference values, e.g., a reference STF, a reference AVD and/or a reference MTF, corresponding to the one or more tested acoustic devices 150 (FIG. 1), e.g., as described above.

In some demonstrative embodiments, as indicated at block 1608, the method may include determining one or more tested acoustic value distributions for the one or more acoustic devices, and determining whether or not the one or more acoustic devices are faulty and/or fail to meet a predefined specification. For example, acoustic device tester 160 (FIG. 1) may be configured to determine the tested acoustic value distributions for the one or more acoustic devices 150 (FIG. 1), and to determine whether or not the one or more acoustic devices 150 (FIG. 1) are faulty and/or fail to meet a predefined specification, for example, based on the tested acoustic value distributions and/or the reference profiles, e.g., as described above.

In some demonstrative embodiments, as indicated at block 1610, the method may include generating and outputting a report based on the test results for the one or more acoustic devices. For example, acoustic device tester 160 (FIG. 1) may be configured to cause output 193 (FIG. 1) and/or interface 1120 (FIG. 1) to output outputting a report based on the test results for the one or more acoustic devices 150 (FIG. 1), e.g., as described above.

Figure 17:
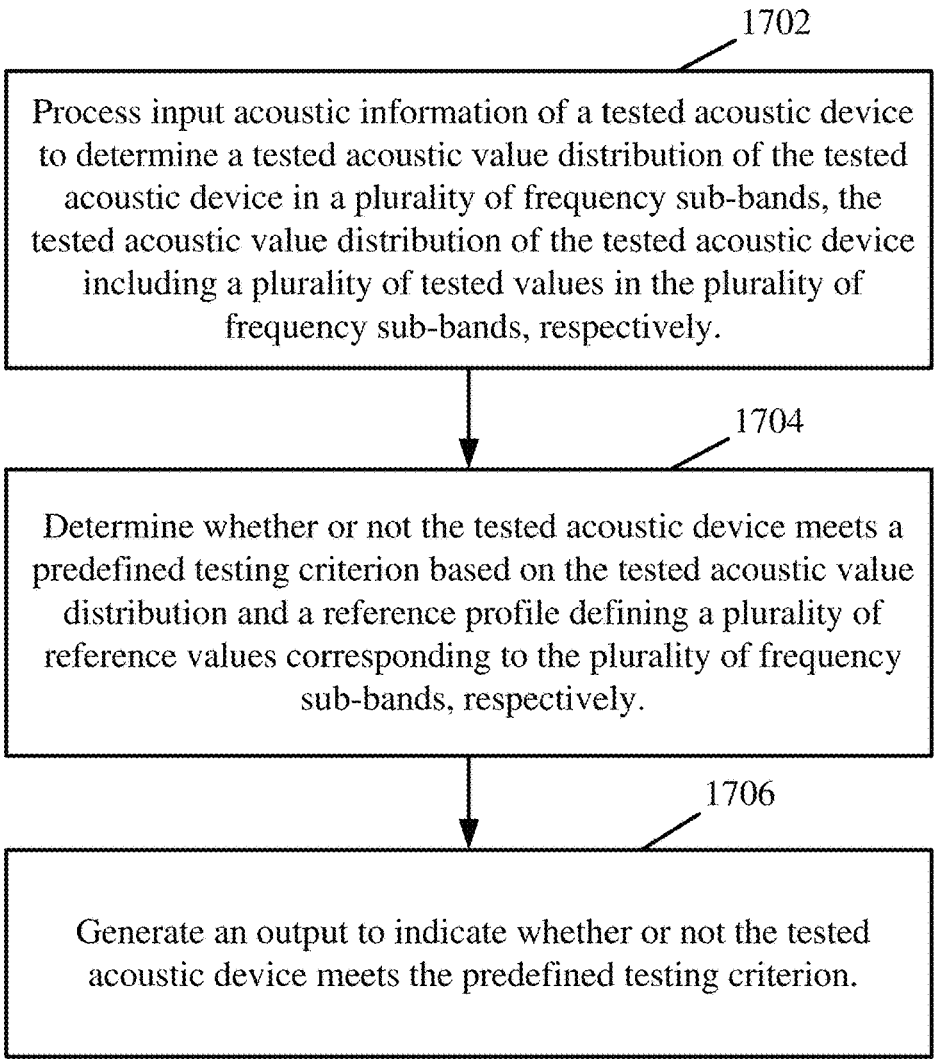
FIG. 17 is a schematic illustration of a flow chart of a method of testing an acoustic device, in accordance with some demonstrative embodiments.

FIG. 17 is a schematic illustration of a flow chart of a method of testing an acoustic device, in accordance with some demonstrative embodiments. For example, one or more operations of the method of FIG. 17 may be performed by device 102 (FIG. 1), server 170 (FIG. 1), acoustic device tester 160 (FIG. 1), and/or acoustic device tester 760 (FIG. 7).

In some demonstrative embodiments, as indicated at block 1702, the method may include processing input acoustic information of a tested acoustic device to determine a tested acoustic value distribution for the tested acoustic device in a plurality of frequency sub-bands. For example, the tested acoustic value distribution for the tested acoustic device may include a plurality of tested values in the plurality of frequency sub-bands, respectively. For example, acoustic device tester 160 (FIG. 1) may be configured to process input acoustic information of tested acoustic device 150 (FIG. 1) to determine a tested acoustic value distribution of the tested acoustic device 150 (FIG. 1) in a plurality of frequency sub-bands, e.g., as described above.

In some demonstrative embodiments, as indicated at block 1704, the method may include determining whether or not the tested acoustic device meets a predefined testing criterion based on the tested acoustic value distribution and a reference profile defining a plurality of reference values corresponding to the plurality of frequency sub-bands, respectively. For example, acoustic device tester 160 (FIG. 1) may be configured to determine whether or not the tested acoustic device 150 (FIG. 1) meets the predefined testing criterion, for example, based on the tested acoustic value distribution and the reference profile, e.g., as described above.

In some demonstrative embodiments, as indicated at block 1706, the method may include generating an output to indicate whether or not the tested acoustic device meets the predefined testing criterion. For example, acoustic device tester 160 (FIG. 1) may be configured to generate an output, e.g., via interface 110 (FIG. 1), to indicate whether or not the tested acoustic device 150 (FIG. 1) meets the predefined testing criterion, e.g., as described above.

Figure 18:
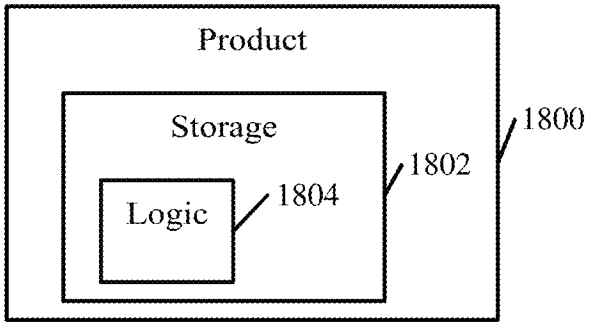
FIG. 18 is a schematic illustration of a product, in accordance with some demonstrative embodiments.

Reference is made to FIG. 18, which schematically illustrates a product of manufacture 1800, in accordance with some demonstrative embodiments. Product 1800 may include one or more tangible computer-readable ("machine-readable") non-transitory storage media 1802, which may include computer-executable instructions, e.g., implemented by logic 1804, operable to, when executed by at least one computer processor, enable the at least one computer processor to implement one or more operations at device 102 (FIG. 1), server 170 (FIG. 1), and/or acoustic device tester 160 (FIG. 1), to cause device 102 (FIG. 1), server 170 (FIG. 1), and/or acoustic device tester 160 (FIG. 1) to perform, trigger and/or implement one or more operations and/or functionalities, and/or to perform, trigger and/or implement one or more operations and/or functionalities described with reference to the FIGS. 1, 2, 3, 4, 5, 6, 7, 8, 9, 10, 11, 12, 13, 14, 15, 16, and/or 17, and/or one or more operations described herein. The phrases "non-transitory machine-readable medium" and "computer-readable non-transitory storage media" may be directed to include all computer-readable media, with the sole exception being a transitory propagating signal.

In some demonstrative embodiments, product 1800 and/or machine-readable storage medium 1802 may include one or more types of computer-readable storage media capable of storing data, including volatile memory, non-volatile memory, removable or non-removable memory, erasable or non-erasable memory, writeable or re-writeable memory, and the like. For example, machine-readable storage medium 1802 may include, RAM, DRAM, Double-Data-Rate DRAM (DDR-DRAM), SDRAM, static RAM (SRAM), ROM, programmable ROM (PROM), erasable programmable ROM (EPROM), electrically erasable programmable ROM (EEPROM), Compact Disk ROM (CD-ROM), Compact Disk Recordable (CD-R), Compact Disk Rewriteable (CD-RW), flash memory (e.g., NOR or NAND flash memory), content addressable memory (CAM), polymer memory, phase-change memory, ferroelectric memory, silicon-oxide-nitride-oxide-silicon (SONOS) memory, a disk, a Solid State Drive (SSD), a floppy disk, a hard drive, an optical disk, a magnetic disk, a card, a magnetic card, an optical card, a tape, a cassette, and the like. The computer-readable storage media may include any suitable media involved with downloading or transferring a computer program from a remote computer to a requesting computer carried by data signals embodied in a carrier wave or other propagation medium through a communication link, e.g., a modem, radio or network connection.

In some demonstrative embodiments, logic 1804 may include instructions, data, and/or code, which, if executed by a machine, may cause the machine to perform a method, process and/or operations as described herein. The machine may include, for example, any suitable processing platform, computing platform, computing device, processing device, computing system, processing system, computer, processor, or the like, and may be implemented using any suitable combination of hardware, software, firmware, and the like.

In some demonstrative embodiments, logic 1804 may include, or may be implemented as, software, a software module, an application, a program, a subroutine, instructions, an instruction set, computing code, words, values, symbols, and the like. The instructions may include any suitable type of code, such as source code, compiled code, interpreted code, executable code, static code, dynamic code, and the like. The instructions may be implemented according to a predefined computer language, manner or syntax, for instructing a processor to perform a certain function. The instructions may be implemented using any suitable high-level, low-level, object-oriented, visual, compiled and/or interpreted programming language, such as C, C++, Java, BASIC, Matlab, Pascal, Visual BASIC, assembly language, machine code, and the like.

EXAMPLES

The following examples pertain to further aspects.

Example 1 includes a product comprising one or more tangible computer-readable non-transitory storage media comprising computer-executable instructions operable to, when executed by at least one processor, enable the at least one processor to cause an acoustic device tester to process input acoustic information of a tested acoustic device to determine a tested acoustic value distribution for the tested acoustic device in a plurality of frequency sub-bands, the tested acoustic value distribution for the tested acoustic device comprising a plurality of tested values in the plurality of frequency sub-bands, respectively; determine whether or not the tested acoustic device meets a predefined testing criterion based on the tested acoustic value distribution and a reference profile defining a plurality of reference values corresponding to the plurality of frequency sub-bands, respectively; and generate an output to indicate whether or not the tested acoustic device meets the predefined testing criterion.

Example 2 includes the subject matter of Example 1, and optionally, wherein the instructions, when executed, cause the acoustic device tester to determine whether the tested acoustic device meets the predefined testing criterion based on a difference value corresponding to a frequency sub-band, the difference value comprising a difference between a tested value corresponding to the frequency sub-band and a reference value corresponding to the frequency sub-band.

Example 3 includes the subject matter of Example 2, and optionally, wherein the reference profile defines a threshold corresponding to the frequency sub-band, wherein the instructions, when executed, cause the acoustic device tester to determine that the tested acoustic device fails to meet the predefined testing criterion, based on a determination that the difference value corresponding to the frequency sub-band is greater than the threshold corresponding to the frequency sub-band.

Example 4 includes the subject matter of any one of Examples 1-3, and optionally, wherein the reference profile comprises threshold information defining a plurality of thresholds corresponding to the plurality of frequency sub-bands, the instructions, when executed, cause the acoustic device tester to determine a plurality of difference values corresponding to the plurality of frequency sub-bands, respectively, a difference value corresponding to a frequency sub-band comprising a difference between a tested value corresponding to the frequency sub-band and a reference value corresponding to the frequency sub-band; and determine whether or not the tested acoustic device meets the predefined testing criterion based on the plurality of difference values and the plurality of thresholds.

Example 5 includes the subject matter of Example 4, and optionally, wherein the plurality of thresholds comprises a first threshold corresponding to a first frequency sub-band, and a second threshold corresponding to a second frequency sub-band, the second threshold is different from the first threshold.

Example 6 includes the subject matter of Example 5, and optionally, wherein the plurality of thresholds comprises a third threshold corresponding to a third frequency sub-band, the third threshold is equal to the second threshold.

Example 7 includes the subject matter of any one of Examples 4-6, and optionally, wherein the threshold information defines a first threshold value to be set for a first plurality of thresholds corresponding to a first plurality of frequency sub-bands in a first frequency range, and a second threshold value, different from the first threshold value, to be set for a second plurality of thresholds corresponding to a second plurality of frequency sub-bands in a second frequency range.

Example 8 includes the subject matter of any one of Examples 4-7, and optionally, wherein the instructions, when executed, cause the acoustic device tester to determine that the tested acoustic device fails to meet the predefined testing criterion based on a determination that, for at least one particular frequency sub-band, a difference value corresponding to the particular frequency sub-band is greater than a threshold corresponding to the particular frequency sub-band.

Example 9 includes the subject matter of any one of Examples 4-8, and optionally, wherein the instructions, when executed, cause the acoustic device tester to determine that the tested acoustic device meets the predefined testing criterion based on a determination that, for each particular frequency sub-band, a difference value corresponding to the particular frequency sub-band is not greater than a threshold corresponding to the particular frequency sub-band.

Example 10 includes the subject matter of any one of Examples 1-9, and optionally, wherein the instructions, when executed, cause the acoustic device tester to select the reference profile from a plurality of a reference profiles based on at least one attribute corresponding to the tested acoustic device.

Example 11 includes the subject matter of Example 10, and optionally, wherein the plurality of reference profiles comprises a first reference profile defining a first plurality of reference values, and a second reference profile defining a second plurality of reference values, wherein the first plurality of reference values is different from the second plurality of reference values.

Example 12 includes the subject matter of Example 10 or 11, and optionally, wherein the at least one attribute corresponding to the tested acoustic device comprises a sensor/transducer attribute defining whether the tested acoustic device is an acoustic sensor or an acoustic transducer Example 13 includes the subject matter of any one of Examples 10-12, and optionally, wherein the at least one attribute corresponding to the tested acoustic device comprises an assembly-configuration attribute defining a configuration of an assembly of the tested acoustic device in a tested device or system Example 14 includes the subject matter of any one of Examples 1-13, and optionally, wherein the instructions, when executed, cause the acoustic device tester to determine the plurality of reference values based on reference acoustic information of a reference acoustic device, which meets the predefined testing criterion.

Example 15 includes the subject matter of any one of Examples 1-14, and optionally, wherein the tested acoustic device comprises an acoustic transducer, wherein the input acoustic information of the tested acoustic device is based on an output signal of an acoustic sensor subject to an acoustic signal output by the acoustic transducer.

Example 16 includes the subject matter of any one of Examples 1-14, and optionally, wherein the tested acoustic device comprises an acoustic sensor, wherein the input acoustic information of the tested acoustic device is based on an output signal of the acoustic sensor.

Example 17 includes the subject matter of any one of Examples 1-16, and optionally, wherein the instructions, when executed, cause the acoustic device tester to process input acoustic information corresponding to acoustic signals communicated between the tested acoustic device and a plurality of other acoustic devices, to determine a plurality of tested acoustic value distributions corresponding to a respective plurality of combinations of the tested acoustic device with the plurality of other acoustic devices; determine a plurality of test results for the plurality of tested acoustic value distributions, wherein a test result for a particular tested acoustic value distribution is based on tested values of the particular tested acoustic value distribution and a reference profile for the particular tested acoustic value distribution; and determine whether or not the tested acoustic device meets the predefined testing criterion based on the plurality of test results.

Example 18 includes the subject matter of any one of Examples 1-17, and optionally, wherein the instructions, when executed, cause the acoustic device tester to determine a tested value for a frequency sub-band based on a sum of acoustic values in the frequency sub-band.

Example 19 includes the subject matter of any one of Examples 1-18, and optionally, wherein the plurality of frequency sub-bands comprises a plurality of ⅓-octave bands.

Example 20 includes the subject matter of any one of Examples 1-19, and optionally, wherein the plurality of frequency sub-bands comprises at least 5 frequency sub-bands.

Example 21 includes the subject matter of any one of Examples 1-20, and optionally, wherein the plurality of frequency sub-bands comprises at least 18 frequency sub-bands.

Example 22 includes the subject matter of any one of Examples 1-21, and optionally, wherein the tested acoustic value distribution comprises a tested acoustic energy distribution comprising a plurality of tested energy values in the plurality of frequency sub-bands.

Example 23 includes the subject matter of any one of Examples 1-22, and optionally, wherein the tested acoustic value distribution represents a tested acoustic transfer function of the tested acoustic device.

Example 24 includes the subject matter of any one of Examples 1-23, and optionally, wherein the instructions, when executed, cause the acoustic device tester to determine whether or not the tested acoustic device meets a runtime testing criterion relating to runtime conditions during operation of a device comprising the tested acoustic device, wherein the input acoustic information of the tested acoustic device comprises runtime acoustic information at the runtime conditions.

Example 25 includes the subject matter of any one of Examples 1-24, and optionally, wherein the instructions, when executed, cause the acoustic device tester to determine whether or not the tested acoustic device meets an End of Line (EOL) testing criterion relating to EOL conditions at an EOL manufacturing process of the tested acoustic device, wherein the input acoustic information of the tested acoustic device comprises EOL acoustic information at the EOL conditions.

Example 26 includes the subject matter of any one of Examples 1-25, and optionally, wherein the instructions, when executed, cause the acoustic device tester to determine whether or not the tested acoustic device meets a post-assembly testing criterion relating to post-assembly conditions of the tested acoustic device assembled in a device, wherein the input acoustic information of the tested acoustic device comprises post-assembly acoustic information at the post-assembly conditions.

Example 27 includes an apparatus comprising a memory to store a reference profile defining a plurality of reference values corresponding to a plurality of frequency sub-bands, respectively; and an acoustic device tester to process input acoustic information of a tested acoustic device to determine a tested acoustic value distribution for the tested acoustic device in the plurality of frequency sub-bands, the tested acoustic value distribution for the tested acoustic device comprising a plurality of tested values in the plurality of frequency sub-bands, respectively; determine whether or not the tested acoustic device meets a predefined testing criterion based on the tested acoustic value distribution and the reference profile; and generate an output to indicate whether or not the tested acoustic device meets the predefined testing criterion.

Example 28 includes the subject matter of Example 27, and optionally, the subject matter according to any one of Examples 1-26.

Example 29 includes a method of testing an acoustic device, the method comprising processing input acoustic information of a tested acoustic device to determine a tested acoustic value distribution for the tested acoustic device in a plurality of frequency sub-bands, the tested acoustic value distribution for the tested acoustic device comprising a plurality of tested values in the plurality of frequency sub-bands, respectively; determining whether or not the tested acoustic device meets a predefined testing criterion based on the tested acoustic value distribution and a reference profile defining a plurality of reference values corresponding to the plurality of frequency sub-bands, respectively; and generating an output to indicate whether or not the tested acoustic device meets the predefined testing criterion.

Example 30 includes the subject matter of Example 29, and optionally, one or more operations according to any one of Examples 1-26.

Example 31 comprises an apparatus comprising means for executing any of the described operations of Examples 1-26.

Example 32 comprises an apparatus comprising: a memory interface; and processing circuitry configured to: perform any of the described operations of Examples 1-26.

Example 33 comprises a method comprising any of the described operations of Examples 1-26.

Functions, operations, components and/or features described herein with reference to one or more aspects, may be combined with, or may be utilized in combination with, one or more other functions, operations, components and/or features described herein with reference to one or more other aspects, or vice versa.

While certain features have been illustrated and described herein, many modifications, substitutions, changes, and equivalents may occur to those skilled in the art. It is, therefore, to be understood that the appended claims are intended to cover all such modifications and changes as fall within the true spirit of the disclosure.

What is claimed is:

1. A product comprising one or more tangible computer-readable non-transitory storage media comprising computer-executable instructions operable to, when executed by at least one processor, enable the at least one processor to cause an acoustic device tester to:

process input acoustic information of a tested acoustic device to determine a tested acoustic value distribution for the tested acoustic device in a plurality of frequency sub-bands, the tested acoustic value distribution for the tested acoustic device comprising a plurality of tested values in the plurality of frequency sub-bands, respectively;

determine whether or not the tested acoustic device meets a predefined testing criterion based on the tested acoustic value distribution and a reference profile defining a plurality of reference values corresponding to the plurality of frequency sub-bands, respectively, wherein the reference profile comprises threshold information defining a plurality of thresholds corresponding to the plurality of frequency sub-bands, wherein the plurality of thresholds comprises a first threshold corresponding to a first frequency sub-band, and a second threshold corresponding to a second frequency sub-band, the second threshold is different from the first threshold, wherein the first threshold comprises a first failure threshold to identify failure with respect to the first frequency sub-band, wherein the second threshold comprises a second failure threshold, different from the first failure threshold, to identify failure with respect to the second frequency sub-band, wherein the instructions, when executed, cause the acoustic device tester to:

determine a plurality of difference values corresponding to the plurality of frequency sub-bands, respectively, wherein the plurality of difference values comprises a first difference value corresponding to the first frequency sub-band and a second difference value corresponding to the second frequency sub-band, wherein the first difference value comprises a difference between a first tested value corresponding to the first frequency sub-band and a first reference value corresponding to the first frequency sub-band, and wherein the second difference value comprises a difference between a second tested value corresponding to the second frequency sub-band and a second reference value corresponding to the second frequency sub-band; and determine whether or not the tested acoustic device meets the predefined testing criterion based on the plurality of difference values and the plurality of thresholds; and generate an output to indicate whether or not the tested acoustic device meets the predefined testing criterion.

2. The product of claim 1, wherein the instructions, when executed, cause the acoustic device tester to determine whether or not the tested acoustic device meets the predefined testing criterion based on a plurality of comparison results corresponding to the plurality of frequency sub-bands, wherein the plurality of comparison results comprises a first comparison result corresponding to the first frequency sub-band, and a second comparison result corresponding to the second frequency sub-band, wherein the first comparison result is based on a comparison between the first difference value and the first threshold, and the second comparison result is based on a comparison between the second difference value and the second threshold.

3. The product of claim 1, wherein the instructions, when executed, cause the acoustic device tester to determine that the tested acoustic device fails to meet the predefined testing criterion based on at least one of a first failure determination or a second failure determination, wherein the first failure determination comprises a determination that the first difference value corresponding to the first frequency sub-band exceeds the first threshold corresponding to the first frequency sub-band, wherein the second failure determination comprises a determination that the second difference value corresponding to the second frequency sub-band exceeds the second threshold corresponding to the second frequency sub-band.

4. The product of claim 1, wherein the plurality of thresholds comprises a third threshold corresponding to a third frequency sub-band, the third threshold is equal to the second threshold.

5. The product of claim 1, wherein the threshold information defines a first frequency-range threshold value to be set for a first plurality of thresholds corresponding to a first plurality of frequency sub-bands in a first frequency range, and a second frequency-range threshold value, different from the first frequency-range threshold value, to be set for a second plurality of thresholds corresponding to a second plurality of frequency sub-bands in a second frequency range.

6. The product of claim 1, wherein the instructions, when executed, cause the acoustic device tester to determine that the tested acoustic device fails to meet the predefined testing criterion based on a determination that, for at least one particular frequency sub-band, a difference value corresponding to the particular frequency sub-band is greater than a threshold corresponding to the particular frequency sub-band.

7. The product of claim 1, wherein the instructions, when executed, cause the acoustic device tester to determine that the tested acoustic device meets the predefined testing criterion based on a determination that, for each particular frequency sub-band, a difference value corresponding to the particular frequency sub-band is not greater than a threshold corresponding to the particular frequency sub-band.

8. The product of claim 1, wherein the instructions, when executed, cause the acoustic device tester to select the reference profile from a plurality of a reference profiles based on at least one attribute corresponding to the tested acoustic device.

9. The product of claim 8, wherein the plurality of reference profiles comprises a first reference profile defining a first plurality of reference values, and a second reference profile defining a second plurality of reference values, wherein the first plurality of reference values is different from the second plurality of reference values.

10. The product of claim 8, wherein the at least one attribute corresponding to the tested acoustic device comprises a sensor/transducer attribute defining whether the tested acoustic device is an acoustic sensor or an acoustic transducer.

11. The product of claim 8, wherein the at least one attribute corresponding to the tested acoustic device comprises an assembly-configuration attribute defining a configuration of an assembly of the tested acoustic device in a tested device or system.

12. The product of claim 1, wherein the instructions, when executed, cause the acoustic device tester to determine the plurality of reference values based on reference acoustic information of a reference acoustic device, which meets the predefined testing criterion.

13. The product of claim 1, wherein the tested acoustic device comprises an acoustic transducer, wherein the input acoustic information of the tested acoustic device is based on an output signal of an acoustic sensor subject to an acoustic signal output by the acoustic transducer.

14. The product of claim 1, wherein the tested acoustic device comprises an acoustic sensor, wherein the input acoustic information of the tested acoustic device is based on an output signal of the acoustic sensor.

15. The product of claim 1, wherein the instructions, when executed, cause the acoustic device tester to:

process input acoustic information corresponding to acoustic signals communicated between the tested acoustic device and a plurality of other acoustic devices, to determine a plurality of tested acoustic value distributions corresponding to a respective plurality of combinations of the tested acoustic device with the plurality of other acoustic devices;

determine a plurality of test results for the plurality of tested acoustic value distributions, wherein a test result for a particular tested acoustic value distribution is based on tested values of the particular tested acoustic value distribution and a reference profile for the particular tested acoustic value distribution; and determine whether or not the tested acoustic device meets the predefined testing criterion based on the plurality of test results.

16. The product of claim 1, wherein the instructions, when executed, cause the acoustic device tester to determine a tested value for a frequency sub-band based on a sum of acoustic values in the frequency sub-band.

17. The product of claim 1, wherein the plurality of frequency sub-bands comprises a plurality of ⅓-octave bands.

18. The product of claim 1, wherein the plurality of frequency sub-bands comprises at least 5 frequency sub-bands.

19. The product of claim 1, wherein the tested acoustic value distribution comprises a tested acoustic energy distribution comprising a plurality of tested energy values in the plurality of frequency sub-bands.

20. The product of claim 1, wherein the tested acoustic value distribution represents a tested acoustic transfer function of the tested acoustic device.

21. The product of claim 1, wherein the instructions, when executed, cause the acoustic device tester to determine whether or not the tested acoustic device meets a runtime testing criterion relating to runtime conditions during operation of a device comprising the tested acoustic device, wherein the input acoustic information of the tested acoustic device comprises runtime acoustic information at the runtime conditions.

22. The product of claim 1, wherein the instructions, when executed, cause the acoustic device tester to determine whether or not the tested acoustic device meets an End of Line (EOL) testing criterion relating to EOL conditions at an EOL manufacturing process of the tested acoustic device, wherein the input acoustic information of the tested acoustic device comprises EOL acoustic information at the EOL conditions.

23. The product of claim 1, wherein the instructions, when executed, cause the acoustic device tester to determine whether or not the tested acoustic device meets a post-assembly testing criterion relating to post-assembly conditions of the tested acoustic device assembled in a device, wherein the input acoustic information of the tested acoustic device comprises post-assembly acoustic information at the post-assembly conditions.

24. An apparatus comprising:

a memory to store a reference profile defining a plurality of reference values corresponding to a plurality of frequency sub-bands, respectively, wherein the reference profile comprises threshold information defining a plurality of thresholds corresponding to the plurality of frequency sub-bands, wherein the plurality of thresholds comprises a first threshold corresponding to a first frequency sub-band, and a second threshold corresponding to a second frequency sub-band, the second threshold is different from the first threshold, wherein the first threshold comprises a first failure threshold to identify failure with respect to the first frequency sub-band, wherein the second threshold comprises a second failure threshold, different from the first failure threshold, to identify failure with respect to the second frequency sub-band; and an acoustic device tester to:

process input acoustic information of a tested acoustic device to determine a tested acoustic value distribution for the tested acoustic device in the plurality of frequency sub-bands, the tested acoustic value distribution for the tested acoustic device comprising a plurality of tested values in the plurality of frequency sub-bands, respectively;

determine whether or not the tested acoustic device meets a predefined testing criterion based on the tested acoustic value distribution and the reference profile, wherein the acoustic device tester is configured to:

determine a plurality of difference values corresponding to the plurality of frequency sub-bands, respectively, wherein the plurality of difference values comprises a first difference value corresponding to the first frequency sub-band and a second difference value corresponding to the second frequency sub-band, wherein the first difference value comprises a difference between a first tested value corresponding to the first frequency sub-band and a first reference value corresponding to the first frequency sub-band, and wherein the second difference value comprises a difference between a second tested value corresponding to the second frequency sub-band and a second reference value corresponding to the second frequency sub-band; and determine whether or not the tested acoustic device meets the predefined testing criterion based on the plurality of difference values and the plurality of thresholds; and generate an output to indicate whether or not the tested acoustic device meets the predefined testing criterion.

25. The apparatus of claim 24, wherein the acoustic device tester is configured to determine whether or not the tested acoustic device meets the predefined testing criterion based on a plurality of comparison results corresponding to the plurality of frequency sub-bands, wherein the plurality of comparison results comprises a first comparison result corresponding to the first frequency sub-band, and a second comparison result corresponding to the second frequency sub-band, wherein the first comparison result is based on a comparison between the first difference value and the first threshold, and the second comparison result is based on a comparison between the second difference value and the second threshold.

26. A method of testing an acoustic device, the method comprising:

processing input acoustic information of a tested acoustic device to determine a tested acoustic value distribution for the tested acoustic device in a plurality of frequency sub-bands, the tested acoustic value distribution for the tested acoustic device comprising a plurality of tested values in the plurality of frequency sub-bands, respectively;

determining whether or not the tested acoustic device meets a predefined testing criterion based on the tested acoustic value distribution and a reference profile defining a plurality of reference values corresponding to the plurality of frequency sub-bands, respectively, wherein the reference profile comprises threshold information defining a plurality of thresholds corresponding to the plurality of frequency sub-bands, wherein the plurality of thresholds comprises a first threshold corresponding to a first frequency sub-band, and a second threshold corresponding to a second frequency sub-band, the second threshold is different from the first threshold, wherein the first threshold comprises a first failure threshold to identify failure with respect to the first frequency sub-band, wherein the second threshold comprises a second failure threshold, different from the first failure threshold, to identify failure with respect to the second frequency sub-band, wherein determining whether or not the tested acoustic device meets the predefined testing criterion comprises:

determining a plurality of difference values corresponding to the plurality of frequency sub-bands, respectively, wherein the plurality of difference values comprises a first difference value corresponding to the first frequency sub-band and a second difference value corresponding to the second frequency sub-band, wherein the first difference value comprises a difference between a first tested value corresponding to the first frequency sub-band and a first reference value corresponding to the first frequency sub-band, and wherein the second difference value comprises a difference between a second tested value corresponding to the second frequency sub-band and a second reference value corresponding to the second frequency sub-band; and determining whether or not the tested acoustic device meets the predefined testing criterion based on the plurality of difference values and the plurality of thresholds; and generating an output to indicate whether or not the tested acoustic device meets the predefined testing criterion.

27. The method of claim 26 comprising determining whether or not the tested acoustic device meets the predefined testing criterion based on a plurality of comparison results corresponding to the plurality of frequency sub-bands, wherein the plurality of comparison results comprises a first comparison result corresponding to the first frequency sub-band, and a second comparison result corresponding to the second frequency sub-band, wherein the first comparison result is based on a comparison between the first difference value and the first threshold, and the second comparison result is based on a comparison between the second difference value and the second threshold.

* * * * *